US005294374A

United States Patent [19]

Martinez et al.

[11] Patent Number: 5,294,374

[45] Date of Patent: Mar. 15, 1994

[54] ELECTRICAL OVERSTRESS MATERIALS AND METHOD OF MANUFACTURE

[75] Inventors: Henry Martinez; Joann Yastine, both of Torrance; Steven Chen, Pasadena, all of Calif.

[73] Assignee: Leviton Manufacturing Co., Inc., Little Neck, N.Y.

[21] Appl. No.: 855,325

[22] Filed: Mar. 20, 1992

[51] Int. Cl.[5] ..... H01B 1/00; H01B 1/14; H01B 1/20

[52] U.S. Cl. ..... 252/518; 252/515; 252/521; 338/21; 338/22 R; 338/225 D; 425/327; 425/329

[58] Field of Search ..... 252/504, 506, 510, 518, 252/519, 521, 512; 338/21, 22 R, 5 D; 428/327, 329

[56] References Cited

U.S. PATENT DOCUMENTS

| | | | |
|---|---|---|---|
| 2,796,505 | 6/1957 | Bocciarelli | 206/66 |
| 2,952,761 | 9/1960 | Smith-Johannsen | 219/19 |
| 2,978,665 | 4/1961 | Vernet et al. | 338/223 |
| 3,210,460 | 10/1965 | Suelmann | 174/73 |
| 3,210,461 | 10/1965 | Berg et al. | 252/516 |
| 3,412,200 | 11/1968 | Virsberg | 174/102 |
| 3,576,387 | 4/1971 | Derby | 174/36 |
| 3,682,841 | 8/1972 | Matsuoka et al. | 252/518 |
| 3,687,871 | 8/1972 | Masuyama et al. | 252/518 |
| 3,849,333 | 11/1974 | Lloyd et al. | 252/511 |
| 3,859,569 | 1/1975 | Kresge | 317/68 |
| 3,863,193 | 1/1975 | Matsuura et al. | 338/20 |
| 3,896,480 | 7/1975 | Harnden, Jr. | 357/80 |
| 3,900,432 | 8/1975 | Marcus et al. | 252/519 |
| 3,936,396 | 2/1976 | Masuyama et al. | 252/518 |
| 3,938,725 | 2/1976 | Hardwick et al. | 228/155 |
| 3,950,604 | 4/1976 | Penneck | 174/68 A |
| 3,954,419 | 5/1976 | Kaufman et al. | 29/182.5 |
| 4,011,360 | 3/1977 | Walsh | 428/402 |
| 4,032,965 | 6/1977 | Cline et al. | 357/76 |
| 4,097,834 | 6/1978 | Mar et al. | 338/20 |
| 4,103,274 | 7/1978 | Burgess et al. | 328/21 |
| 4,127,511 | 11/1978 | Klein et al. | 252/518 |
| 4,146,677 | 3/1979 | Merz et al. | 428/428 |
| 4,163,204 | 7/1979 | Sado et al. | 338/114 |
| 4,166,159 | 8/1979 | Pober | 429/193 |
| 4,172,922 | 10/1979 | Merz et al. | 428/432 |
| 4,174,530 | 11/1979 | Kregge et al. | 361/127 |
| 4,184,984 | 1/1980 | Levinson | 252/518 |
| 4,205,298 | 5/1980 | Shapiro et al. | 338/308 |
| 4,207,482 | 6/1980 | Neumeyer et al. | 310/45 |
| 4,219,862 | 8/1980 | Nitta et al. | 361/120 |
| 4,234,902 | 11/1980 | Fujiwara et al. | 361/120 |
| 4,252,692 | 2/1981 | Taylor et al. | 252/504 |
| 4,278,961 | 7/1981 | Schroeder et al. | 338/21 |
| 4,290,041 | 9/1981 | Utsumi et al. | 338/21 |
| 4,306,214 | 12/1981 | Miyabayashi et al. | 338/21 |
| 4,316,171 | 2/1982 | Miyabayashi et al. | 338/21 |
| 4,320,436 | 3/1982 | Bushnell | 361/128 |
| 4,331,948 | 6/1982 | Malinaric et al. | 338/21 |
| 4,333,861 | 6/1982 | Aoki et al. | 252/518 |
| 4,338,223 | 7/1982 | Yokomizo et al. | 252/519 |
| 4,347,505 | 8/1982 | Anderson | 340/666 |

(List continued on next page.)

*Primary Examiner*—Christine Skane
*Assistant Examiner*—M. Kopec
*Attorney, Agent, or Firm*—Matthew F. Jodziewicz

[57] ABSTRACT

This invention provides a method of preparing an electrical overstress material having a nonlinear resistance which declines sharply in response to an electric field exceeding a clamping voltage so as to be able to shunt out transient surges which method comprises using an adhesive binder, for example a silicone rubber or a ceramics dispersion, and thorough mixing therein of small conductive, and optionally semiconductive particles, for example nickel particles of various morphologies and silicon carbide particles respectively, followed by molding under pressure and curing. The invention is also directed to the electrical overstress material itself which has excellent strength and integrity as well as survivability from multiple surges and has multiple applications in, for example, electrical outlet strips and power cables. The invention is also directed to a power outlet strip comprising a plurality of surge arresting elements composed of the electrical overstress material of the invention.

20 Claims, 4 Drawing Sheets

U.S. PATENT DOCUMENTS

| | | | |
|---|---|---|---|
| 4,364,021 | 12/1982 | Levinson | 338/20 |
| 4,383,237 | 5/1983 | Eda et al. | 338/21 |
| 4,397,773 | 8/1983 | May | 252/518 |
| 4,397,775 | 8/1983 | Levinson | 252/518 |
| 4,420,737 | 12/1983 | Miyoshi et al. | 338/21 |
| 4,430,255 | 2/1984 | Yan | 252/512 |
| 4,431,861 | 2/1984 | Clabburn et al. | 174/73 R |
| 4,438,158 | 3/1984 | Eichelberger et al. | 427/101 |
| 4,438,214 | 3/1984 | Masuyama et al. | 501/136 |
| 4,439,807 | 3/1984 | Reitz | 361/127 |
| 4,444,351 | 4/1984 | Dries et al. | 228/121 |
| 4,450,426 | 5/1984 | Miyoshi et al. | 338/21 |
| 4,452,728 | 6/1984 | Carlson et al. | 252/518 |
| 4,452,729 | 6/1984 | Carlson et al. | 252/518 |
| 4,460,497 | 7/1984 | Gupta et al. | 252/518 |
| 4,460,623 | 7/1984 | Levinson | 427/101 |
| 4,463,268 | 7/1984 | Levinson | 307/106 |
| 4,470,898 | 9/1984 | Penneck et al. | 252/511 |
| 4,472,239 | 9/1984 | Johnson et al. | 156/647 |
| 4,473,765 | 9/1984 | Butman, Jr. et al. | 310/215 |
| 4,473,812 | 9/1984 | Maruyama et al. | 338/21 |
| 4,490,318 | 12/1984 | Masuyama et al. | 264/61 |
| 4,497,533 | 2/1985 | Genova et al. | 339/143 |
| 4,507,359 | 3/1985 | Powers, Jr. | 428/328 |
| 4,510,112 | 4/1985 | Lauf | 264/234 |
| 4,519,942 | 5/1985 | Yamaoka et al. | 252/520 |
| 4,540,604 | 9/1985 | Siuta | 427/96 |
| 4,541,974 | 9/1985 | Yamaoka et al. | 264/61 |
| 4,545,929 | 10/1985 | Masuyama et al. | 252/520 |
| 4,547,314 | 10/1985 | Masuyama et al. | 252/520 |
| 4,549,981 | 10/1985 | Gupta et al. | 252/518 |
| 4,575,440 | 3/1986 | Palilla | 264/61 |
| 4,579,702 | 4/1986 | Maruyama et al. | 264/56 |
| 4,581,621 | 4/1986 | Reed | 357/12 |
| 4,586,074 | 4/1986 | Stapelbroek et al. | 357/58 |
| 4,613,645 | 9/1986 | Robeson et al. | 524/443 |
| 4,624,137 | 11/1986 | Johnson et al. | 73/204 |
| 4,624,990 | 11/1986 | Lunk et al. | 525/199 |
| 4,726,991 | 2/1988 | Hyatt et al. | 428/329 |
| 4,977,357 | 12/1990 | Shrier | 338/21 |
| 4,992,333 | 3/1991 | Hyatt | 428/102 |

FOREIGN PATENT DOCUMENTS

| | | |
|---|---|---|
| 1135076 | 8/1966 | United Kingdom . |
| 1253239 | 11/1967 | United Kingdom . |
| 1294665 | 11/1972 | United Kingdom . |

Translent I/V Characteristic Curve of Example 4

ELECTRICAL OVERSTRESS MATERIALS AND METHOD OF MANUFACTURE

NOTICE REGARDING COPYRIGHTED MATERIAL

A portion of the disclosure of this patent document contains materials which are subject to copyright protection. The copyright owner has no objection to the facsimile reproduction by anyone of the patent document or the patent disclosure as it appears in the Patent and Trademark office patent file or records, but otherwise reserves all copyright rights whatsoever.

BACKGROUND OF THE INVENTION

The present invention relates in general to electrical circuit protection materials and methods, and, in particular to novel electrical overstress materials capable of conforming to predetermined shapes, as well as novel methods and processes for producing such materials. Apparatus for practicing the novel methods and processes, as well as both devices and systems which utilize such novel materials, are also disclosed.

The following specification and claims, read together with the accompanying drawings, are presented merely to teach examples and embodiments of the present invention, and should not be read or construed as limiting the proper scope of the claimed invention.

Conventional surge protection devices include fuses, varistors, Zener diodes, spark gap and thin-film devices, along with electronic filter circuits. Each of these devices and circuits is shown to have one shortcoming or another in countering the effects of fast-rise, broad frequency spectrum, transient voltage or current surges, or in recovering from such repeated surges.

More specifically, conventional surge protection devices are too slow in reaction times to provide protection for many modern delicate circuit elements, have inadequate voltage dissipation capacity to protect such delicate circuit elements from large electrical stresses, and are subject to destructive breakdown after a single high voltage surge, thereby leaving the circuit unprotected from any subsequent surge.

The concept of clamping voltage is also important in understanding electrical overstress materials. Clamping voltage, in relation to the nonlinear resistance characteristics of a device, is usually considered as being the overall or bulk resistance of a surge protection device or material in relation to a voltage applied to it. For applied voltages below the clamping voltage, a nonlinear resistance device, such as a varistor, offers the circuit a high resistance approaching the characteristics of an insulator, while, for applied voltages substantially above the clamping voltage, the device offers the circuit a substantially reduced resistance capable of shunting transient electrical surges to ground.

The prior art contains teachings of electrical resistance composites intended for purposes similar to that of the present invention, but they differ from the present invention and do not accomplish the same results.

U.S. Pat. No. 4,977,357 issued to Shrier discloses an electrical overstress material having conductive particles uniformly dispersed in an insulating matrix or binder to provide material having non-linear resistance characteristics that are determined by the interparticle spacing within the binder as well as by the electrical properties of the insulating binder. U.S. Pat. No. 4,726,991 issued to Hyatt et al. discloses specific materials intended for electrical overstress protection and provides both a general overview of the problem and a survey of the known prior art. Hyatt et al. proposes a material for electrical overstress protection that has a nonlinear resistance as the voltage across it varies. The material comprises a matrix containing a mixture of small conductive and semiconductive particles coated with inorganic insulating material that permits nonlinear conduction between the particles in response to electrical transients by what is believed to be the quantum mechanical tunneling of electrons in the matrix materials. In a preferred embodiment the material includes a binder or packaging material in which the particles are generally homogeneously mixed.

U.S. Pat. No. 4,359,414, issued to Mastrangelo, discloses an electric current regulating junction capable of being electrically switched between low resistance and relatively high resistance states by the application of a relatively low current pulse and that is useful as a computer memory storage element. The material comprises a normally insulative, electrically activatable composition disposed as a layer 0.1 to 2,540 microns in thickness that has an electrical resistance greater than $10^8$ ohms through its thickness. The composition consists essentially of 10 to 85 volume percent of a substantially linear, unitary polymeric binder having a glass transition temperature of at least 100 degrees Centigrade and is selected from aromatic polimides, aromatic poly(amides-imides), aromatic poly(ester-imides) and aromatic polyamides. The binder has 15 to 90 volume percent of particles of aluminum substantially homogeneously dispersed in it. The aluminum particles are stated to have electrically conductive metallic interiors and thin electrically insulative surface coatings of aluminum oxide sufficient to impart electric resistance between any two or more particles in contact with each other. However, this patent neither states nor suggests the use of semiconductive particles, whether they be coated or not, nor does it provide for its junction material automatically returning to its high resistive state once an initial triggering pulse is shunted to ground.

SUMMARY OF THE INVENTION

It is one object of the present invention to provide an improved method of preparing a nonlinear electrical resistance material useful for protecting electrical or electronic equipment against transient voltage surges.

It is a further object of this invention to provide a method capable of producing a material that can withstand repeated transient voltage surges while retaining useful surge protective properties.

It is a still further object of this invention to provide a method which can produce a material capable of converting to either a high or low resistance state, as desired, as a result of a catastrophic electrical stress overload or failure.

A further object of this invention is to provide a method which can produce such a material capable of indicating that it has been degraded in its surge protective characteristics.

Yet another object of the present invention is to provide a material having an improved, nonlinear electrical resistance, that is useful in protecting electrical equipment against damage from transient voltage surges, and which can be formed into protective components having opposed electrode-contactable surfaces offering therebetween a substantially insulating resistance below a characteristic clamping voltage, and a substantially conducting resistance above the clamping voltage.

It is a more specific object of this invention to provide a material, readily formable into voltage surge protective components, that can repeatedly withstand and exhibit a fast response time to broad frequency spectrum electrical voltage surges that may rise to voltages substantially in excess of the clamping voltage of the components.

It is another object of this invention to provide a material having an improved combination of clamping voltage and recovery characteristics to transient voltage surges.

It is yet another object of this invention to provide a material which has a small, consistent spacing between conductor or semiconductor particles forming the material.

As specified by Underwriters Laboratories, desirable characteristics for a voltage surge-arresting product designed for 13 outdoor use, would include the product having a resistance of at least 100K ohms at 200 volts, which is considered as being adequate to keep voltage leakage below 3.5 milliamps at 169 volts, 169 volts being the peak voltage generated by US domestic power supplies operating at 120 volts A.C.

Thus, it is a further object of this invention to meet this specification by providing a material of a practical thickness having a clamping voltage below 600 volts, and more preferably below 400 volts, that may be used with a standard domestic power supply operating at a nominal voltage of 110 volts A.C.

Further objects lie in providing improved voltage and current surge-protection devices incorporating surge-arresting materials, especially the novel materials of the present invention, and in providing improved and novel electrical equipment and components incorporating surge protection features derived from the presence of such materials.

According to the present invention, there is provided both non-linear electrical resistance materials and a method of preparing a nonlinear electrical resistance material useful for protecting electrical equipment and circuits against transient voltage surges. A method in accord with the present invention of preparing a nonlinear electrical resistance material useful for protecting electrical equipment and circuits against transient voltage surges comprises the steps of:

composing a mixture having: (1) a curable binder of substantially insulative electrical resistivity; and, (2) an electrical filler material, comprising about 15 to 97 volume percent of the mixture, with from 50 to 100 volume percent of the filler being conductor particles having no applied coating, and the remaining 0 to 50 volume percent of the filler being semiconductor particles having no applied coating;

mixing the mixture until a uniform consistency is obtained of the binder and filler materials and the filler particles are substantially all coated with the binder;

molding the mixture under pressure into a shaped, coherent self-supporting material where the filler particles are packed closely together so that interparticle spaces are filled with binder and are substantially free of voids; and, selecting the manufacturing conditions (such as, mixing time, temperature, barometric pressure, etc.), proportions and ingredients of the nonlinear electrical resistance material to provide a material having a clamping voltage that presents a substantially open circuit to voltage surges below the clamping voltage, and repeatedly capable of maintaining the clamping voltage during repeated surges in excess of the clamping voltage.

Clearly, in any sophisticated method of manufacture, there are many detailed variables such as, but not limited to, time, s temperature, ingredient quality, small changes in proportions and the like, which can affect the quality and characteristics of the end product. Thus, once the quality and characteristics of the end product are known or selected, these variables are adjusted, and the particular method is refined according to the quality and characteristics of the product it produces.

It is a feature of the present invention that for a given formulation, its mechanical properties can serve as a guide to the quality and characteristics of its electrical properties. Thus, variations in tensile strength, for example, can indicate deviation from the material's desired processing parameters. This feature enables a speedier optimization of the manufacturing and testing processes, as tests to determine the electrical characteristics of a material are both time consuming and expensive to complete compared with simple, mechanical tests for such characteristics as tensile strength of the material.

Another important feature of the present invention is that it is possible with this invention to provide a transient voltage surge arresting material which not only has desirable clamping voltage, response and recovery characteristics, but which also displays an important "fail-safe" ability, in that when exposed to an overwhelming high current surge, for example, a lightning strike in its immediate vicinity, it substantially resists the current surge to avoid dissipation of large quantities of energy in the material. Contrary to this, some prior art voltage surge protection devices are prone to catastrophic breakdown in response to such overwhelming, high current surges and may respond with potentially explosive effects, possibly releasing noxious gases, flames and toxic particles into the local environment. Underlying this aspect of the invention is a novel realization that it may become more important to guard against the risk of fire in the protecting device than to continue to try to save the equipment being safeguarded.

Further objects and advantages of the present invention and its features will suggest themselves to those skilled in the art upon a reading of the present specification.

DESCRIPTION OF PREFERRED EMBODIMENTS

Figure 1A:
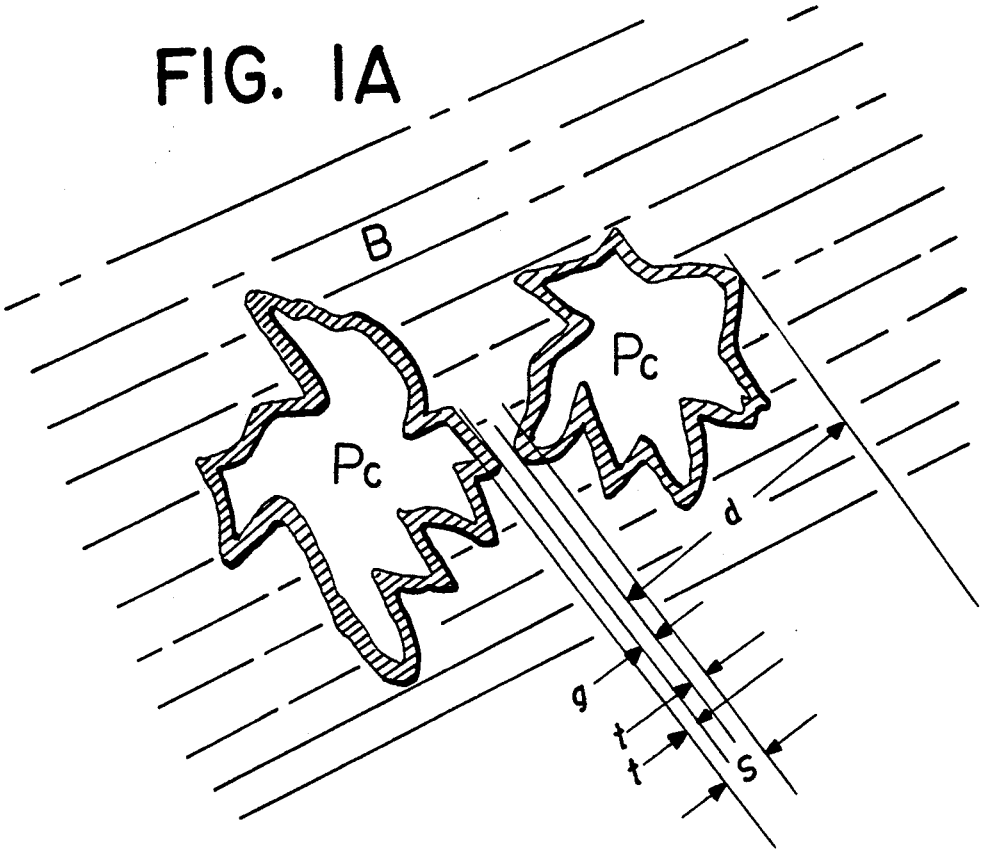
FIGS. 1A and 1B are enlarged and idealized schematic depictions of the particulate relationship and binder matrix of the composite in accordance with the present invention.

Throughout the drawings, identical elements are identified with the same reference numerals.

It should be noted that the relative proportions of the ingredients used in the methods and materials of this invention are, in most cases herein, expressed for convenience in volume percent or volume proportions because, in one aspect of the invention, we are concerned with the spatial characteristics of the materials more than their weight-related reactivity.

A preferred embodiment of the method of this invention, useful for preparing surge arresting materials, comprises a relatively intense or thorough mixing process in which conductive or semiconductive particulate materials, or both, are mixed to the point of creating a substantially uniform dispersion in a binder material having relatively high tensile strength and wettability so as to be capable of holding the particles bound together in a formed, dimensionally stable, shock-resistant material, after curing, if necessary.

Sufficiently intense mixing can be achieved in high-shear mixing apparatus as for example, a two-roller mill or internal mixers with cam blades, roller blades, sigma blades, or the like.

While the binder is in the mixing apparatus, the particulate material is added to it in a manner which enhances the degree of mixing and encourages the formation of a substantially uniform dispersion, for example, by adding portions at a predetermined particular rate while the binder is being worked and moving in the mixing apparatus.

The particulate materials should be sufficiently small in size to encourage electron transport in the end product in response to a substantial applied voltage of at least one volt per mil. Likewise, the loading of particles in the binder, or the proportional volume of particles to binder, should also be high enough to encourage substantial electron transport in the end product material when the particles are properly and efficiently dispersed throughout the binder.

In order to illustrate advantageous embodiments of this invention, without limiting its scope of application, some preferred binder and particulate materials that can be used as ingredients in the method of this invention will now be described and discussed, after which some preferred and illustrative embodiments of the method will be described and exemplified.

In general, ingredients, other than those described, may be included in the end product materials of this invention if their impact on the electrical properties of the material is clearly known and that such additives have an acceptable impact upon the desired electrical and mechanical properties of those materials.

A broad prescription for a preferred binder material has been outlined above. It is desirable that the binder material have, in an uncured state, if appropriate, a low enough viscosity to be capable of mixing with the desired proportions of particulate materials. The uncured binder material should have adequate wettability to be capable of substantially completely coating the particles and, in this sense, must therefore be somewhat adhesive, although not so adhesive as to prevent mechanical working in a mixer. The uncured binder material should also have adequate tensile strength to produce a stable, uniform dispersion, and preferably, with partial curing if necessary, should have adequate tensile strength to provide a self-supporting, shapeable mass. The binder should preferably also be curable to provide a tough, dimensionally stable material, capable of being shaped in an uncured, or partially cured state. The most preferable shape known at present are thin sheets or films for reasons discussed below.

A good elastomer is an excellent binder material because it provides an end product which is shock-resistant. Since elastomers do not have a crystalline structure, there are no shear lines to promote fracturing. This strength is further promoted by cross-linking a polymeric binder, or by vulcanizing an elastomeric binder. Such cross-linking assists in providing a tenacious material that can provide excellent physical or physicochemical bonding to conductor or semiconductor particles holding them together in a coherent, nonfriable material.

A preferred organic polymeric binder is a silicone rubber that has a high amount of inert filler such as calcium carbonate or preferably silicon compounds that give the binder stiffness. However, binders with less filler may also have advantages. More specifically, the preferred silicone rubber for use as such an inert filler, is a polysiloxane, of general formula $—R_2SiO—$ where R is a monovalent organic radical, preferably methyl. Such silicone rubbers are commonly supplied as a somewhat wet, clay-like mass of modest tensile strength which can be compounded, with a catalyst, and vulcanized, usually at elevated temperatures, to provide a harder, relatively high tensile strength, somewhat resilient material, the precise characteristics of which can be varied by selection of the particular polymer formulation of the catalyst and of the processing conditions and proportions. In order to preserve or control the desirable electrical characteristics of the end product, and avoid undesirable reactions with the catalyst system, depending on the catalyst used, metallic impurities in the raw polymer should not exceed from 3 to 5 parts per million (ppm) for aluminum or iron; and, from 5 to 10 ppm for magnesium; or from 500 to 1000 ppm for zinc.

Other binder materials can be a room temperature vulcanizate (RTV) which could, for example, be a silicone RTV. In general, silicone rubbers are more desirable for their processability, as they can be pelletized and injection-molded, which are useful manufacturing characteristics.

Many other moldable organic polymers can be used as binder material, for example, copolymers of ethylene with vinyl acetate (commonly known as polyvinyl acetate), polyethylene and tetrafluorethylene. Polyimides are desirable for their electrical characteristics and their temperature stability and their ability to form thin films. However, polyimides tend to be expensive and have to be worked at relatively high temperatures, thus rendering their processing expensive Epoxy resins are undesirable since they are hydrophilic and need drying.

It is desirable for the binder to be a very high resistance or insulating material Additionally, It should be nontoxic and ozone-stable. Furthermore, the binder must be capable of being compounded with the conductive particles described herein, so a certain wettability is desirable It is also preferable that the binder be capable of thoroughly coating the particles to exclude air.

It is also desirable that the binder have a moderate dielectric strength to yield low-capacitative end products with fast response times. (Dielectric strength is to be distinguished from resistivity which relates to constant current flow. Silicone rubber has a dielectric strength of approximately 400–500 volts per mil. Polyvinyl acetate exhibits the same strength or slightly higher.)

Another class of suitable binder materials are curable, paste-like ceramic materials having sufficient viscosity to support an effective proportion of conductor or semiconductor powders in a suspension or dispersion, and which are capable of being thoroughly mixed with or compounded with these powders or particles. Preferred ceramic materials are those which, upon firing, at either a high or a low temperature, can be sintered to a material with s high electrical resistance with relatively superior dielectric strength. The ceramic material should also be moldable into a variety of shapes.

Specific examples of such materials are a moldable putty #360M and fiber adhesive #901 both from Cotronics Corp. that have the following published characteristics:

| | #360M Moldable putty | #901 Fiber Adhesive |
|---|---|---|
| Appearance: | white putty | white paste |
| Density: | 40 lb./ft3 | 120 lb./ft3 |
| Melting point: | 3200 degrees F. | 3200 degrees F. |
| Compressive strength: | 1500 psi | 6500 psi |
| Specific Heat: | 0.25 BTU/deg F. | 0.25 BTU/deg F. |
| Dielectric Strength: | 100 volts/mil | 100 volts/mil |
| Dielectric Constant @ 108 cps: | 1.61 | 1.61 |
| Loss factor: | 0.017 | 0.017 |

The end materials produced by the method of this invention are characterized by having a nonlinear resistance, in the sense that they exhibit a pronounced reduction in resistance above a certain gradient of applied voltage known as the clamping voltage.

Preferably, nontoxic materials are utilized both as the ingredients for and the products of the present invention.

Furthermore, since the catastrophic destruction of these materials is a possibility in use, ingredients have been chosen according to the present invention, so that the end products do not generate significant quantities of toxic materials, especially fumes, when heated or combusted or when attempting to dissipate a catastrophic electrical overstress.

Examples of powdered conductor particles which are preferably utilized in the method and material of this invention are: nickel flakes having a 99.3% purity with 0.3% nickel oxide; nickel spheres having a 99.82% purity With 0.0475% carbon, 0.017% oxygen, 0.012% elemental iron and 0.0003% sulfur Aluminum, with trace impurities of silicon, copper, manganese, iron, magnesium or titanium, is also a suitable conductor particle material Another suitable conductor material is a spiky or pointed surface nickel element with a purity, including nickel oxide, of 99.9% and impurities of up to 0.05% cobalt, 0 006% carbon, 0.05% iron, 0.007% sulfur and 0.005% copper.

The spacing between the conductor particles in the end product material is important. The conductor particles should be closely packed to enhance desired electron transport to provide a conductive path through the material in response to an applied electric field yielding a voltage gradient in excess of the material's clamping voltage gradient. The present invention ensures that a sufficient number of the particles are separated by an insulating material to avoid the formation of a conductive pathway through the materials at voltage gradients below the clamping voltage. In this regard, it is a feature of this invention that the material retains its low voltage insulative properties after arresting or diverting repeated higher voltage transients or surges, i.e., that it resists breakdown.

Thermally stable conductors, such as carbide or titanium carbide or tungsten metal, assist the material to withstand high energy surges without breakdown, because they are less prone to fuse and will create permanent conductive filaments than lower melting point metals, for example aluminum.

Closer spacing of the conductor and semiconductor particles enhances electron transport and will reduce the clamping voltage characteristics of the material. "Electron transport" as the term is used herein, includes, but is not limited to, the various means of electron transport, such as, classical quantum electron tunneling, quantum mechanical electron tunneling, electron tunneling, electron avalanche and thermionic transport, and means that, at certain electrical junctions in the presence of electrical fields, electrons pass through insulating material even though the theoretical energy barrier imposed by the junction exceeds the energy of at least some of the electrons which are transported through the barrier. The exploration of such behavior in many instances depends upon a probabilistic model of electron behavior, and electrons which transverse the junction barrier are described as doing so by "tunneling" rather than because their respective energies exceed the barrier energy.

In practice, the surge arresting material of the present invention is formed to have the conductor and semiconductor particles packed together as closely as possible, consistent with their being separated by insulative binder or carrier material. The particles are dispersed in the binder with as many particles as feasible surrounded with the binder and preferably with substantially all the particles being substantially completely surrounded.

So long as it is substantially above the peak values of the intended operating voltage, a lower clamping voltage is utilized to divert or shunt out a full range of potentially harmful transients. The particles may be close to touching each other in an optimal formulation of the present invention.

Interparticle spacing can be greater than the maximum particle size. Irregularities in the particle surface may facilitate or even enhance electron transport or tunneling. In a preferred embodiment of a surge arresting material in accord with the present invention, conductor to conductor contact between the particles is minimized or prevented, and the particles are separated by the carrier or an insulative or a semiconductor coating.

The conductive particles may have various morphologies—for example, flakes, rods, spheres or a particle having a spiky surface. Many of these morphologies occur in nickel particles.

The particular morphology of the conductor particles selected for use in the present invention, is an important aspect of certain detailed embodiments of this invention. The selection of specific morphologies for the conductor particles is an area in which novel features have been obtained in unique materials having new and useful benefits.

In preferred embodiments of this invention, the particulate conductor particles used are substantially free of sharp points or surface discontinuities that are likely to focus electric fields to produce hot spots when the material is subjected to high energy surges. Thus, on the microscopic level, it is preferred that there be a minimization of discontinuities in surface tangent vectors as they travel across a spherical or etched particle.

The limit of this minimization is a spherical particle, and this shape does exhibit superior characteristics. However, spiky particles that are somewhat rounded or smoothed also exhibit favorable properties, as will be described.

Conductor particles, for example metallic particles such as nickel, are commercially available in a diversity of morphologies or shapes. Some of these morphologies are modifiable by chemical means such as etching or mechanical means such as fusion, to have a unique or novel character.

Some of these modified morphologies are spiky, flaky, planar flaky, spherical, cylindrical or rod-like, and fiber rods.

The Hyatt et al. reference cited above teaches that spicules, i.e. spikes, points, or the like, will enhance the electric fields and improve electron tunneling effects. However, it has been learned through experimentation that materials based on spicules usually have difficulty recovering to a high off-state resistance after a surge. The material is apparently readily degraded by the formation of permanent conductive or semiconductive paths through the material due to the heat developed at high energy fields on the tips of the spicules.

Generally spherical particles, according to the present invention, are formulated into a material having useful clamping voltages combined with good recovery properties. The material is returned to a high off-state resistance with little, if any, degradation following a surge.

Degradation of the material may be apparent from observation of the material surface after subjecting it to one or more transients or high voltage pulses on a standardized basis. There may be a hole, or it may be ruptured. Another test for degradation of the material is to measure the off-state resistance of a sample of the material after a pulse test using standard current versus voltage measurement techniques. A significant reduction in resistance of the test sample normally indicates degradation.

The conductive particles are preferably either coated or uncoated metal particles. Coating introduces an additional process step. The coating, if present, is preferably insulative or semiconductive, and is tenaciously bonded to the conductive particles to provide shock-resistant coated particles having relatively good integrity and dimensional stability. This is important since the particles will be subjected to a mechanically rigorous mixing process.

Conductive particles such as metals, including nickel, may be provided with a thin semiconductor coating, preferably by oxidation. Aluminum may be coated with different oxides or with its naturally occurring oxide, both of which are insulative. Iron may be coated with ferric oxide or ferrosoferric oxide (magnetite $Fe_3O_4$).

Preferably, the coating is durable as well as chemically and dimensionally stable. The conductor is preferably selected to be a metal that is treatable to provide such a coating as its reaction product. Brittle, flaky or friable coatings are undesirable since they may become damaged during processing, leading to undesirable interparticle conductive contacts and particle surfaces which have unpredictable electrical characteristics. Some silicates and glasses exhibit these undesirable characteristics. Preferably, the coating and conductor materials are selected such that the coating is securely and permanently bonded to the exterior of the conductor particle so that the coating will maintain its integrity through subsequent processing and while in use in the end product.

Many metals, including aluminum and nickel, have a natural oxide coating. In the case of aluminum, this coating is about 40 Angstroms thick whereas the natural oxide coating on nickel particles is only about 10 to 20 Angstroms thick. The applied coatings described herein according to this invention are thicker than the natural coatings, being at least 70 Angstroms thick, and are preferably less than one tenth of the particle's overall diameter and less than 1 micron, though an upper limit of 0.5 microns is preferred. Depending upon the particle size, the coating thickness is preferably from 1/10 to 1/10000 of the overall particle diameter size.

A preferred range of coating thickness for the conductive particles is from 10 to 5000 Angstroms depending on end-user application. Exemplary thicknesses of oxidized coatings on nickel are 200 Angstroms and 1600 Angstroms.

Figure 1B:
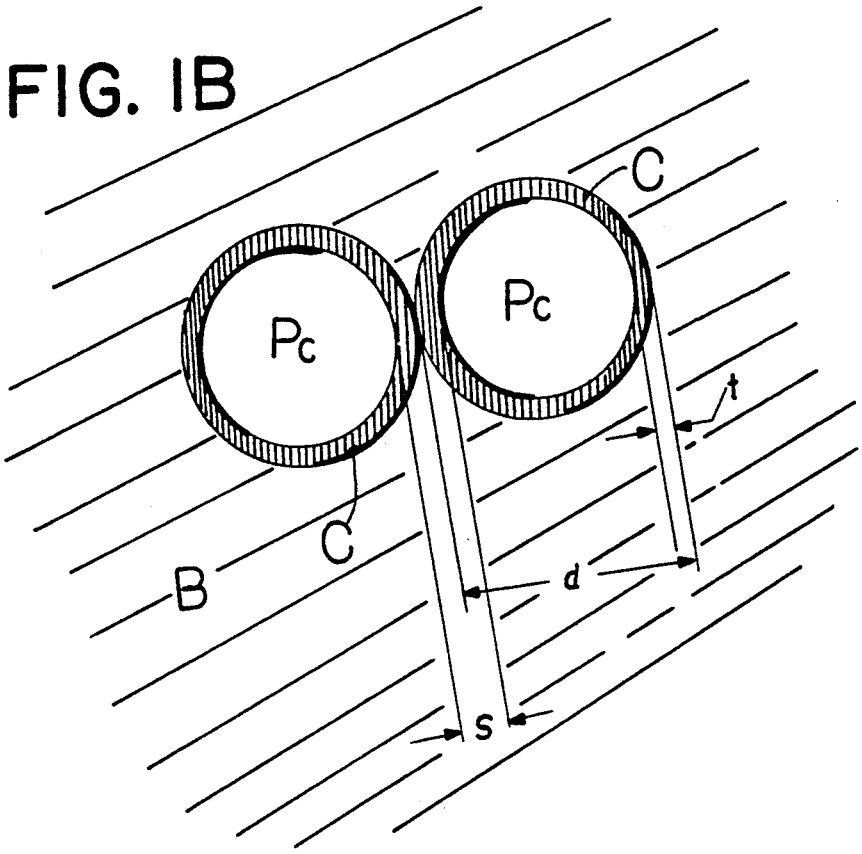

FIGS. 1A and 1B of the drawings are each enlarged and idealized schematic depictions of the particulate relationship and binder matrix of the composite in accordance with the present invention. FIG. 1A shows the particuate conductive particles to have a spiky or irregular morphology, while FIG. 1B shows the particulate conductive particles to have a regular or spherical morphology. Each of these two Figures shows two conductive particles Pc having a coating C of insulative or semiconductor material of thickness (t) giving the coated particle a diameter of (d). The particles Pc have an overall interparticle spacing (S), referring to the surface of the particle Pc beneath the coating C and by a distance (g) referring to the outer surfaces of the coated particles. It is preferred that the overall interparticle spacing be from about 20 Angstroms to about 1 micron; that (d) be from about 1000 Angstroms (0.1 microns), or more preferably, from about 1 micron to about 100 microns; that (t) be from about 0.1d to 0.00001d (10-5d); while (g) is from zero to (S-2t). The particles Pc are shown embedded in a binder matrix B which is more fully discussed below.

The metal particles are preferably oxidized in an oven or a fluidized bed, carefully controlling time and temperature to produce the desired oxide coating thickness. The coating thickness and quality may be verified optically, electrically or spectroscopically.

Alternatively, such an oxidation process may be carried out in a fluidized bed chamber with suitable, oxidizable metallic particles at elevated temperatures below the melting point of the metal using air or an oxygen and inert gas mixture.

Various oxidation methods can be used to increase oxide thickness on metal particles. Examples are immersion of the particulates to be coated in distilled water or hydrogen peroxide solution. Immersion may produce a different oxide coating from that achieved with air oxidation. In this manner, the trihydrate of aluminum oxide, $Al_2O_3.3H_2O$, is formed.

Some other possible methods of coating the conductor particles comprise: mechano-fusion techniques, solgel, wet chemical oxidation, emulsion methods, microencapsulation and heterocoagulation, fluidized bed, chemical vapor deposition, or hybrid reactions, and applying a low viscosity polymer, such as polymethyl methacrylate.

Some other coating materials that can be used are polymethyl methacrylate applied in a slurry technique and silane-derived materials. Mechano-fusion techniques may be used to apply coatings, for instance polymethyl methacrylate, to particles that are at least 7 microns across.

Depending upon the formulation of the material, a coating on the conductive particles serves to provide carefully controlled and known interparticle spacing in the end product material, if the particles are closely packed to a maximum achievable particle density, and are thus nearly touching each other.

As noted in U.S. Pat. No. 4,726,991, very fine powders may be used to coat the conductive particles, for example, titanium oxide, fumed silica and ferric oxide powders.

In general, an applied coating of approximately uniform thickness is preferred, although highly contoured particles, for example, spiky ones, may trap uneven deposits of mechanically applied coatings such as powders or polymers. The coating processes do not alter the shape of the particles. However, with mechano-fusion some deformation may occur and uneven coatings may be produced, due to metallic debris in the coating from the mechano-fusion process. The original particle shape may be changed by the mechano-fusion force allowing additional area for coating with metal oxide Or other semiconductor. Scanning electron micrographs verify this effect.

Alternatively, the conductor particles of this invention may be layered, having a nonconductive interior of insulating or semiconductive material covered with a layer of conductive material, with or without an outer semiconductive coating as herein described.

One preferred material for the semiconductor particles is silicon carbide. Silicon carbide is a dark green to black material which is economical, nontoxic, and easy to work with. The cubic, alpha phase of silicon carbide provides superior results.

It is preferred that the materials used have a high degree of purity and are free of contaminants that might interfere with the s electrical characteristics of the product or that may react with additives or catalysts used in curing the binder.

Likewise, it is preferred that the semiconductor material be of very high purity, preferably plasma grade, (at least 99.99% pure). The semiconductor material is preferably a dry, bulk-packed powder. In one embodiment the particles have an average overall particle size of about 5 microns.

Other semiconductor materials that may be used are transitional metal oxides, for example ferrosoferric oxide (Magnetite, $Fe_3O_4$), zinc oxide and nickel oxide. Less pronounced results are obtained with tin oxide (noting that tin is not a transitional metal).

Examples of suitable semiconductor materials with indicated impurities by weight are: a silicon carbide which is at least 98.5% pure with the following impurity maxima: free carbon 0.21%; free silicon 0.07%; total aluminum 0.03%; total iron 0.03%; total titanium 0.009%; total tungsten and cobalt less than 0.01 each. Iron oxides, ferric or ferrosoferric can be 99.9% pure as can stannous oxide. Titanium dioxide is preferred in the rutile phase with a purity of at least 94% and impurities not exceeding 0.001% for arsenic, 0.02% for iron, 0.03% for lead, 0.01% for zinc and 5.94% of elemental tin. Zinc oxide with a purity of 99.9% is a further suitable semiconductor material and its impurities should not exceed 0.001% aluminum, 0.001% beryllium, 0.001% calcium, 0.001% copper 0.001% magnesium and 0.009% titanium.

Addition of nickel oxide or zinc oxide particles to nickel binary formulations exhibit varistor effects in the observed waveform. A preferred waveform for voltage across the material plotted against time, yields a voltage clamp level which remains flat throughout a transient surge event, as opposed to a crowbar-shaped waveform which yields a spike, then crowbars down close to ground.

Clamping voltages below 600 volts and around 28o or 300 volts may be obtained with uncoated semiconductor particles of several materials in a ternary formulation.

The present invention does not require the use of any insulative coating on the semiconductor particles. Excellent effects are obtained and useful materials are fabricated using semiconductor particles which present a semiconducting surface to the binder material. An insulative material is thus unnecessary.

However, it is also considered to be within the scope of the present invention to include semiconductive particles having an insulative coating, whether such insulative coating be applied, or naturally occurring. Application of such coatings may be done as disclosed above for coatings applied to the conductive particles.

Preferred semiconductor materials are substantially nonreactive with the carrier and any catalysts or additives that may be present in the carrier during formulation, curing and shaping of the material, bearing in mind that elevated temperatures are often required. Using a silicone rubber carrier, copper and manganese oxides are contra-indicated for reactivity reasons. Specifically, such reactivity may affect the surface characteristics of the semiconductor material and thus its electrical properties rendering the latter unpredictable.

Different semiconductor and metal oxide materials exhibit one or another of two types of conduction: ionic or electronic. Most transitional metal oxides, for example those of nickel and zinc, exhibit electronic conduction. Normal, nontransitional metal oxides, for example, those of aluminum, germanium and tin, exhibit ionic conduction. Silicon carbide is ionic. Thus, nickel, zinc, ferric or titanium oxides, for example, are preferred for their electronic conduction properties.

The semiconductor particles may be "doped" to enhance their properties, to obtain a p-type electron-acceptor or n-type electron donor semiconductor as required by specific application requirements.

Inclusion of semiconductor particles in the material of this invention enhances the survivability of the material through a single high energy transient surge event and will extend its survivability through repeated surges. A current limiting effect can be obtained. The conductive state resistivity of the material is somewhat higher than it is for comparable materials having only conductor particles. Consequently, the peak power from a high energy transient is reduced and the energy is dissipated throughout a longer time interval, inflicting less damage on the material. This effect is seen in changes in the signature of the waveforms, i.e., the shape of the waveform over time, referring to the voltage across the material during a transient.

When the material arrests the surge, there is a high plateau followed almost instantaneously by a very low plateau. An ideal voltage response waveform rises to a particular level, stays at that level remaining flat throughout the transient, and then follows the bulk resistance curve down as the transient passes.

When used in the method of this invention, flaky particles tend to have anisotropic properties, and a distribution having some planar orientation. An orientation of substantially parallel planes of flaky particles is desirable. The orientation is produced as a grain during the mixing of the particles with the carrier. An advantage of having an oriented disposition of particles in the carrier is that it reduces edge effects and facilitates the providing of flat surfaces that may be used to abut flat electrode surfaces in order to distribute the electrical field effectively across the material. Advantageously, surge protective equipment using such a material would employ flattened pieces of material having its oriented planes generally parallel to a pair of flat electrodes.

Such orientation is facilitated during processing with the aid of magnetization, for example by passing a film of material under a magnet after mixing and before curing with a carrier in sufficiently plastic or viscous condition to permit reorientation of the particles without migration. If desired, the particles may be encapsulated in an envelope, or the material may be molded under a magnetic field to encourage planar orientation. Substantially smaller semiconductor particles may be interspersed among the "plates" of oriented conductor particles.

Rod-like particles provide relatively inferior results compared with other shapes, such as spherical particles. Furthermore, the percolation limit is reached sooner with rod-like particles than with spherical particles. Also, there is more degradation of the material in pulse tests with rod-like particles.

Use of spherical particles is also advantageous because it makes the material isotropic. In this case it does not matter on which axis the material is cut. It is isotropic, thus facilitating manufacture since it does not matter on which axis it is milled or how it is pressed. See FIG. 1B.

During molding, increases in the applied pressure can increase the zones of close contact between particles, thus lowering the clamping voltage or the resistance of the material. With spherical, hard metallic particles, such as nickel dispersed in a polymeric binder, the binder deforms around the particles as the mold pressure is increased.

Spherical particles are also advantageous in exhibiting minimal agglomeration of the powder prior to processing. In contrast, spiky particles tend to form "thistles," or long agglomerates tending to form rods, a negative effect. Such agglomerates or couplings can decrease percolation limits and narrow the percolation region.

Furthermore, spherical particles are easier to coat with a binder or a semiconductor material and are more likely to accept an even coating with controlled and predictable physical and electrical characteristics.

In another embodiment of this invention, the conductor particles have a spiky morphology and are used in combination with semiconductor particles. (See FIG. 1A) The survivability and current limiting features realized by including semiconductor particles in the material, as described hereinabove, are substantially more pronounced with spiky particles than with spherical particles. An interaction takes place between the spiky and semiconductor particles which does not appear during experimentation with spherical particles. Experimental results and theoretical interpretation supports this conclusion. The more intense electric fields associated with spiky particles require the moderation provided by the semiconductor particles. In other words, the semiconductor serves to limit electrical field hot spots.

Improved results are obtained by etching spiky particles of a conductor, for example nickel, to reduce the lengths of the spikes or to round out the spikes, or both. The spikes can, for example, be shortened to have an overall radius of from 50 to 90% of the non-etched particle, for example about 70%. It is desirable to conduct the etching to minimize discontinuities in surface tangent vectors as they travel across an etched particle. The etching is done with any conventional acid, as for example dilute hydrochloric acid. The effect of the etching reduces the intensity of the electric fields at the spikes, improving the survivability of the material.

In manufacturing the materials of this invention, component materials are preferably subjected to rigorous particle size analysis.

A particle size that does not exceed 100 microns although 50 microns is a preferred limit with median particle sizes of from 100 angstroms to 100 microns. Still more preferred are particle sizes below 10 microns. However, the end product material thickness is preferably at least 10 times the average particle size. Larger particles more readily form permanent conductive chains, giving the material an undesirably low off-state resistance. For a fixed surge arresting material thickness, larger particles generate higher fields in the gaps between particles, the strengths of which fields being proportional to the particle size. Higher fields are more likely to overcome the dielectric strength of the binder causing breakdown. Larger particles also yield an end product that is more susceptible to breakage.

Different particle sizes of like morphology may be mixed to achieve a higher packing, for example big spheres and little spheres.

Alternatively, or in addition, diverse morphologies may be combined, for example, flaky and spherical particles of nickel.

A narrow particle size distribution is preferred to reduce the probabilities of forming undesired contacting paths. To this end a desired commercially available product should be further refined to reduce the spread of particle sizes and to concentrate it in a preferred size range.

Using, for example the Horiba 700 machine, a range of different conductor particles usable for the purposes of this invention were subjected to particle size analysis, yielding the results shown in Table 1.

TABLE 1

CONDUCTOR PARTICLE SIZE ANALYSIS

| Conductor Material | Median Particle Size | Standard Deviation |
|---|---|---|
| Nickel spheres | 8.61 microns | +/−4.58 microns |
| Nickel, spiky | 6.60 microns | |
| Aluminum spheres | 23.00 microns | |

Data were not taken for nickel flake particles since their irregular shapes and tendency to agglomerate would render the data from a standard size determination misleading or not meaningful.

Similar size determinations were made for some semiconductor materials and the results shown in Table 2 were obtained.

TABLE 2

SEMICONDUCTOR PARTICLE SIZE ANALYSIS

| Semiconductor Material | Median Particle Size | Std Deviation |
|---|---|---|
| Silicon carbide | 5.5 microns | |
| Ferrosoferric oxide | 21.51 microns | +/−14.27 microns |
| Stannous oxide | 3.50 miorons | +/−2.37 microns |
| Zinc oxide | 1.20 microns | +/−0.53 microns |
| Nickel monoxide with 50% free nickel | 8.82 miorons | +/−4.48 microns |
| Ferric oxide | 0.32 microns | +/−0.39 microns |

A typical distribution pattern showing the spread of particle sizes about the median is shown in Table 3 for the nickel spheres of Table 1 which have a median of 8.61 microns with a standard deviation of ± 4.58 microns.

TABLE 3

PARTICLE SIZE DISTRIBUTION FOR NICKEL SPHERES

| Size Range Microns | Volume % | Size Range Microns | Volume % |
|---|---|---|---|
| 27.0–25.5 | 0.0 | 13.5–12.0 | 6.2 |
| 25.5–24.0 | 0.8 | 12.0–10.5 | 8.5 |
| 24.0–22.5 | 0.3 | 10.5–9.00 | 14.0 |
| 22.5–21.0 | 1.4 | 9.00–7.50 | 18.5 |
| 21.0–19.5 | 2.4 | 7.50–6.00 | 18.4 |
| 19.5–18.0 | 2.3 | 6.00–4.50 | 12.7 |
| 18.0–16.5 | 3.4 | .50–3.00 | 4.6 |
| 16.5–15.0 | 2.6 | 3.00–1.50 | 0.6 |
| 15.0–13.5 | 3.3 | 1.50–0.00 | 0.0 |

These tables show that the analysis used found no particles smaller than 1.5 microns which is more than ten percent of the median size, and no particles over 25.5 microns which is less than three times the median size. About ninety percent of the particles were less than twice the median size and 68.8% of them were less than 10.5 microns, with 61% lying within from 4.5 to 10.5 microns which is a fairly narrow distribution. Comparable distributions can be expected for other particles, having regard to their median particle sizes and standard deviations therefrom, noting the figures given in Tables 1 and 2, according to conventional statistical principles. A chart of cumulative volume percentages against particle sizes, as shown in Table 3, yields a curve close to one half of the bell shape that is typical of a random distribution.

The ingredients for the materials of this invention have been carefully selected to minimize or eliminate the risk of generating noxious emissions in the event of a high temperature, catastrophic breakdown due to an overwhelming surge. A silicone elastomer is likely to yield silica, water vapor, and possibly small quantities of carbon dioxide or monoxide, none of which is likely to be noxious in the quantities in which they are generated.

A preferred embodiment of the method of the invention comprises using an elastomeric polymer hardened with inert filler, for example, silicone rubber, up to 40% by volume, adding preferably from 15 to 35% conductor particles with up to 25%, preferably from 12 to 18%, by volume semiconductor particles. A preferred ratio is from 0.75 to 1.5 parts conductor to 1 part of semiconductor particles, by volume.

The term "percolation limit" is introduced herein to refer to a maximum loading or proportion of conductor and semiconductor particles in a binder beyond which proportion no further significant reduction in end product bulk resistivity is obtainable. Conceptually, the percolation limit is the point where the proportion of particulate material is such that, for the respective method of production, the conductive particles contact each other to form a conductive chain or path through the material. The conductive limit is approached asymptotically.

Numerically, this percolation limit may be around 35 to 40 volume percent using spherical conductive particles in an elastomeric binder material that is conventionally hardened with an inert filler material, and may be higher, for example, about 50 to 60 percent by volume for an unfilled elastomer. Indeed, another feature of the present invention is that it is possible to compound a surge-arresting material with so high a proportion of electrical filler material by using an elastomer that it is substantially free of inert filler.

Some especially advantageous materials are obtained by using volume proportions of particulate filler, conductor particles alone, or conductor particles and semiconductor particles combined, which are just short of the percolation limit; in other words, by using the maximum amount of particulate material that will mix and be coated by the binder with a high degree of reliability. Such materials provide superior electrical characteristics showing during a transient surge, relatively modest voltage fluctuations after the initial rise. In view of the teachings of the prior art, it is particularly surprising that such good clamping voltage characteristics can be obtained by what has become known as a binary system, such a system comprising only a binder phase and a conductor particle phase uniformly dispersed therein. The conductor particles may be uncoated or coated with a semiconductor material or insulator, as will be described.

Lower clamping voltages are obtained by adapting the method of production and the material characteristics to approach the percolation limit, which raises the proportion of conductive particles that can be included in the material without creating conductive pathways for lower voltages to percolate through the material.

A preferred silicone rubber is an elastomeric polymer containing —$R_2SiO$— groups where R is a monovalent organic radical, for example methyl, and is preferably filled, if at all, with silica or silicon compounds and vulcanized with a catalyst for example, an organic peroxide such as VAROX, a trademark of R. T. Vanderbilt Co., Inc. The words "fill" and its derivatives are used in this immediate context in the sense the rubber industry uses them to refer to the addition of an inert material to an elastomer to harden it and increase its tensile strength. This material is called an inert filler herein. Within the present art of formulating surge-arresting materials, the word "fill" is used to refer to the addition of particulate conductor or semiconductor material to a binder, which may be a "filled" elastomer, and is called a particulate or electrical filler herein. Sometimes the semiconductor has a dual function and can act both as filler and active agent in the electron transport reaction, thus lowering the overall cost of surge arresting material (SAM).

The method of the invention will now be described by way of example with reference to the use of silicone rubber as the organic, polymeric support material of the invention. Other polymers can be used in a comparable manner, the conditions being adjusted to the other polymer's known characteristics.

To get a homogeneous mix the material is milled between rollers cooled below its vulcanization temperature. Silicone rubber vulcanizes at elevated temperature.

A binder material such as silicone rubber is processed by putting it in a mill having two counter-rotating rollers which have hardened chrome surfaces and which are water-cooled at about room temperature. Mixture quality is determined by visual inspection of the rubber On the mill Or certification of density or electrical properties. A high degree of thorough mixing is desirable and the mixture is thoroughly compounded to appear as homogeneous as possible.

A suitable tool for lab-scale mixing is a two roll mill having 6"-diameter chrome-plated rollers approximately 12" wide disposed in a mixing chamber to which the material is fed through guides offering about a five to six inch gap. The rollers have an adjustable nip, adjustable, for example, from ⅛" to 1.5" and for an effective kneading-shearing action the rollers should counter-rotate at different relative speeds of from, for example, about 1:2 to 1:8, preferably about 1:5. The nip is adjusted for smooth processing and a strong kneading action by opening it to reduce mounding on the rollers.

When first applied the rubber tends to stick to the rollers. It may pull, exhibiting tears and breaks, but after a while there is a flowability imparted to the rubber from the friction of the rollers. Mechanical forces break up agglomerates and soften the rubber.

To promote homogeneity, pieces of rubber emerging from the rollers are cut lengthwise of the rollers, with a blunt instrument, and fed back through the mill, at least 6 and as many as 8 to 12 times or more after the rubber has a homogeneous appearance and an evenness of color.

Cooling is controlled to avoid vulcanization, as indicated, by continuously recorded viscosity increases. Vulcanization temperature is about 200 degrees Centigrade for a preferred silicone rubber, so that cooling to around room temperature or somewhat above is effective in preventing vulcanization. Cooling water at 100 degrees Fahrenheit provides satisfactory results.

To formulate a material having useful electrical surge arresting properties a mixture of conductive nickel particles and semiconductor particles of silicon carbide are added to the rubber according to the following procedure. Firstly, the nickel particles are added to the rubber on the mill, generating lighter colored striations in the rubber as the light colored metal particles blend into it. The technician practicing the novel method outs the visible striations in the rubber across the rollers. Then silicon carbide particles, which present a visibly different color to the nickel, darker striations across the rollers, are added. Cutting is continued until an even tone is obtained, and a further six in and out passes through the mill are then completed. It is also important to conduct the mixing process such that and until the blended material appears to be effectively free of voids or air bubbles.

"Cutting" can be done with a simple relatively blunt instrument such as a sloyd knife drawn across the material on top of a roller, the material being folded back and into itself. The particles are mechanically dispersed in the rubber or blended into it. The two rollers run at different speeds creating a shear line at the nip.

While the semiconductor particles are mixed with or added prior to the conductor particles, it is preferable to add the conductor particles first and mix them into the binder until they are smoothly blended with it or dispersed in it. Being heavier (at least in the case of nickel), the conductor particles are easier to mix.

In general, for preferred results and to optimize the electrical characteristics of the end product, it is desirable to disperse the particles in the binder material as homogeneously, thoroughly, and evenly as possible, and to ensure that the spaces between the particles are closely packed with binder, without voids, gaps or bubbles.

An alternative mixing and kneading apparatus to the roller mill is an internal high-shear mixer operating in several planes. In general, high shear and thorough mixing help improve end product quality.

The blended mixture may then be molded and vulcanized or cured, for example in a hot press in a controlled manner yielding a material of predetermined shape and thickness.

The particle filled silicone rubber polymer mixture is taken off the roller mill in a sheet. A suitably sized piece is cut from the sheet and is placed in a compression mold consisting of an upper and a lower pressure plate, two liners made of tetrafluorethylene, and a molding plate out of which is cut, for example, a square or rectangular molding cavity. A convenient size for the cavity is eight inches square in a 12-inch square molding plate. The tetrafluorethylene is preferably in contact with the material. Mold release agents can also be used to line the metal plates so long as it does not react with the compound during curing.

The method is conducted at normal atmospheric pressure. The cutoff is inserted in the mold at normal pressure, and the mold enters a hot press preheated to 200 degrees Centigrade, and is pressed at 26 tons on a 5 inch diameter ram for approximately ten minutes. The platen temperature of the press is checked before inserting the mold assembly. After pressing, the mold assembly is removed from the hot press where the initial cure is set, and placed in a mechanically similar cold press to cool the material without bubbles, and to reduce cycle time in the hot press. Five minutes is a preferred cooling time. The cold press can be cooled by circulating water at room temperature.

Alternatively, the molded sheets may also be cured in the hot press, but this lengthens the process cycle.

Test results in which there was insufficient hot pressing, yielded a bubbled product, which is undesirable, since bubbles and voids may interfere with the electrical characteristics of the end product.

A useful mold offers a thickness range of from about 15 or 20 mils to about 110 mils with the larger thicknesses being useful for materials with rubber binders, and 40 to 60 mils being a good working range.

The thickness of the molded sheet is determined by the depth of the molding plate, so long as the ram pressure and material quantity are adequate to leave the mold filled. A standard mold thickness, useful for test and production purposes, is 40 mils, while a precision mold useful for comparative test studies may have several cavities ranging from 15 to 100 mils in thickness.

After about five to ten minutes in the cold press for a 40 mil product, or proportionately longer for thicker products, the molded sheets are then post-cured in an oven, with out-gassing, and then air cooled at room temperature.

The oven temperature is chosen according to the polymer being cured, and for silicone rubber, for example, is about 200 degrees Centigrade. Thorough curing is important to remove all latent gases in the product which may otherwise be harmful to sensitive components such as contacts or electrodes of the equipment with which the material is intended to be used, especially in spacecraft applications. Also, such latent gases may produce undesired voids or bubbles at a later date. It is important to ensure that the end product material does not contain voids or air spaces, which may be formed by outgassing.

With a silicone rubber binder, the outgassing product during oven curing comprises hydrocarbons and carbon dioxide. Excessive curing may be detrimental and 4 to 8 hours with a maximum of 10 hours is appropriate for thin sheets of material using a silicone rubber carrier.

In practicing the method of the invention, for a given formulation within manufacturing tolerances, there is a correlation between the mechanical properties of the molded material and its electrical characteristics. Improved hardness and tensile strength can be correlated with desirable electrical features. Electrically improved samples are obtained by refining the procedure for optimal mechanical results, reducing the need for somewhat laborious electrical quality control testing. A "Shore A" durometer test may be used to determine hardness, while tensile strength may be determined by pulling cured sheets apart per ASTM STANDARDS.

Incoming raw materials are preferably received and sampled to test them for mechanical strength and electrical properties by means of test methods recommended by ASTM. Periodically, samples of about 230 gm. are tested by running them through the following production procedure and examining the results.

For certain applications of the product material, tests of the incoming materials are required. For example, frequency response testing of the polymer is desirable for a high frequency application to ensure batch consistency. Manufacturers' normal formulation variations from batch to batch may well affect such sensitive electrical characteristics while still meeting their normal conventional quality control standards which are unrelated to the present invention.

Particle size analysis of any given batch of conductive or semiconductor particles may be accomplished using a sub-sieve analyzer for average particle size and an analyzer for particle size distribution (Gaussian or Poisson).

Depending on the results of these analyses, the powders undergo additional preprocessing (classification) to achieve sharper distribution boundaries. In addition to these techniques, scanning electron microscopy can be used to verify particle sizes and morphology as needed.

A number of examples of nonlinear electrical resistance materials embodying the present invention follow.

The present invention is embodied in a nonlinear electrical resistance material having a binder of substantially insulative electrical resistivity and an electrical filler material comprising conductor particles having no applied coating and semiconductor particles having no applied coating. This material may further include having a semiconductive coating for at least some of its conductor particles.

Another example of a nonlinear electrical resistance material embodying the present invention includes a material having a binder of substantially insulative electrical resistivity, and an electrical filler material comprising conductor particles having a semiconductive coating and semiconductor particles having an insulative coating.

As suggested previously, the nonlinear electrical resistance material may have at least some of its conductor particles such that each comprises an interior of insulative material surrounded by a layer of conductive material and having its semiconductive coating surrounding the conductive layer.

Likewise, the conductive particles may have an applied semiconductive coating, and the semiconductive particles may have an applied insulative coating.

A third example of a nonlinear electrical resistance material embodying the present invention, would include a binder of substantially insulative electrical resistivity, and an electrical filler material comprising conductor particles having no coating and semiconductor particles having an insulative coating.

In each of these examples, the conductor and semiconductor particles are preferably distributed throughout the binder such that the material is substantially homogeneous and free of voids.

Likewise, in each example, the nonlinear electrical resistance material has a clamping voltage such that it presents substantially an open circuit to voltages below the clamping voltage, and it is capable of repeatedly conducting voltage surges in excess of the clamping voltage by such electron transport or conduction means as electron tunneling, or by a sequence of conductivity methods as may be selectively chosen and sequenced by formulation and particle coating design, to include, but not limited to, quantum mechanical electron tunneling, electron avalanche, thermionic transport and electron tunneling.

A number of specific compositions are now provided below.

EXAMPLE 1

This is a process for preparing strips of surge arresting material that can be utilized in an electrical outlet strip.

The materials used are:

100 parts of silicone rubber (Dow-Corning STI) 75 U durometer, into which is admixed 1 part of VAROX or other desired catalyst, which are cut from the clay-like mass in which the material is supplied;

37.5 parts by volume of nickel powder (Novamet, Wyckoff, N.J.) ranging from 7 to 10 microns gross diameter;

24.5 parts by volume of powdered semiconductor particles with an average particle size of 5.5 microns.

Mixing of the particles with the polymer is carried out in a clean, dry atmosphere at room temperature. Silicone rubber is loaded into the nip between the moving rollers where it is kneaded with a shearing action until there is a good flowing body of material with an even color. The conductive nickel particles are then sprinkled on the churning rubber upstream of the nip at a rate regulated to optimize coating of the particles with rubber. With addition of the nickel particles completed and the rollers still turning, thorough mixing of the particles into the rubber with coating and wetting of the particles by the rubber is promoted by cutting the material across a roller, and pulling it back, away from the rollers, then allowing it to fold back into the mixture. Typically the material adheres to the faster, hotter roller. This cutting process is repeated until the particles are thoroughly mixed in the rubber, as indicated by a smooth, even color. After two or three minutes more of mixing, the semiconductor particles are added. If necessary, to avoid mounding on the rollers, the nip is adjusted by increasing the separation between the rollers. The silicon carbide particles are now added in a similar manner to the conductive particles with cutting and folding back of the material for at least six more feedthroughs after which an even, substantially uniform color is obtained with the silicon carbide particles thoroughly admixed and coated or wetted with rubber. There appears to be little, if any, benefit in either more feedthroughs or premixing the two kinds of particles.

The particle filled rubber material is now ready for molding and curing. These steps can be carried out either directly or the material can be stored, covered or wrapped, at room temperature for several hours or overnight.

Using previous experience and judgement to obtain a uniform, void-free product the technician cuts a portion of material adequate to fill the mold and spreads it in the mold cavity of the mold plate lying on one tetrafluorethylene liner and the lower pressure plate of the molding press described herein. The upper pressure plate and liner are assembled with the lower pressure plate to form a sandwich which is introduced into the hot press preheated to 200 degrees Centigrade. The mold plate is selected with a thickness equal to the desired thickness of the end product, for example 40 mils. The press is closed for about ten minutes and, using the 26 ton press and 12-inch pressure plates described herein, the average, terminal molding pressure is about 36 psi.

The press is opened by retracting the lower plate, and the mold assembly comprising the pressure plates, mold plate, tetrafluorethylene liners and molded sheet of material in a sandwich is removed and promptly transferred to a cold press which is as described herein and similar to the hot press except that it is cooled by water circulated at 65 to 100 degrees Fahrenheit. The cold press is closed and the mold assembly can be removed after about five to ten minutes for a 40 mil product. The molding sandwich is disassembled and the cured sheet of material product is removed.

The molded composite material sheets are then postcured in an oven at 200 degrees Centigrade and atmospheric pressure for about 4 to 8 hours, removed from the oven and air cooled at room temperature. The material is now ready for identification and testing. It can be cut into desired shapes such as strips with a sharp blade.

EXAMPLE 2

The method of Example 1 is repeated using 75 volume percent silicone rubber, 20 volume percent etched spiky nickel particles and 5 volume percent silicon carbide. The mixture is thoroughly compounded in the roller mill until even colored and smooth, hot pressed, cooled and cured as described above. For comparison purposes, two batches of silicone rubber of rubber hardness 35 U and 75 U are compounded, hot pressed, cooled and cured in the manner of Example 1 without any conductor or semiconductor "filler" material being added.

The tensile strengths of these two materials were then determined using dumbbell specimens according to ASTM D 412. Both unfilled samples of silicone rubber had tensile strengths in excess of 1340 psi, a typical value for a tough, durable rubber. The "filled" sample containing etched spiky nickel and silicon carbide had a tensile strength in excess of 1000 psi showing it to be a tough material with excellent integrity.

EXAMPLE 3

The method of Example 1 was repeated using 30 volume percent aluminum particles and 70 volume percent silicone rubber with no semiconductor particles other than that used to insure mechanical strength. A molding plate with a depth of approximately 40 mils was used to produce samples having a thickness of about 40 mils. After the process was completed and the material was cured and cooled, samples were submitted to electrical testing to simulate the effect of a high energy electrical surge or transient.

Figure 2:
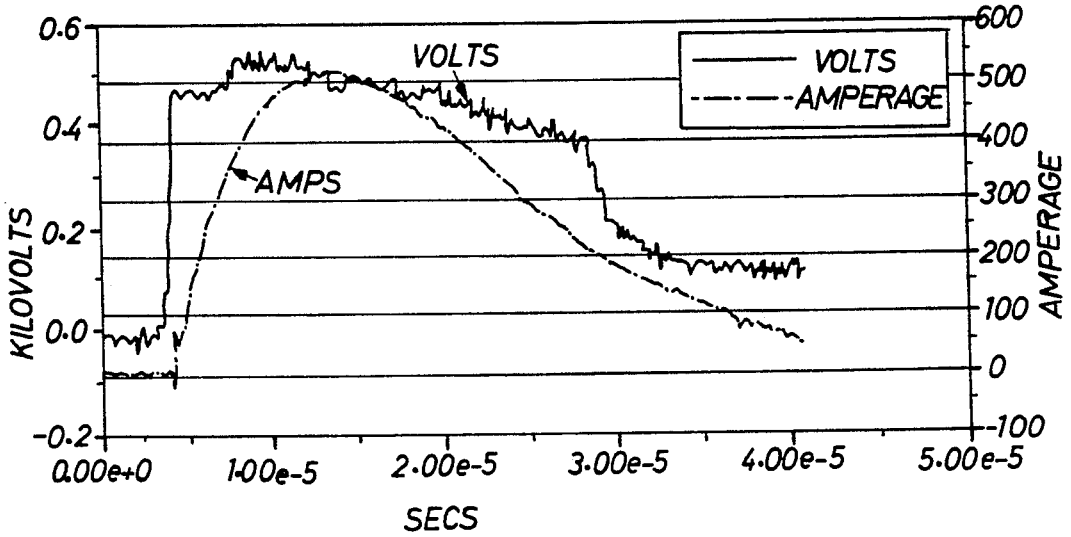
FIG. 2 is a graph constructed from test results obtained from subjecting a material embodying the present invention to a 6 kV, 500 A, 8×20 impulse wave as per the testing standards of UL 1449A.

FIG. 2 illustrates the results of electrical testing of a number of formulations similar to of Example 3 that were subjected to a 6 kV, 500 A, 8×20 impulse wave of 8×20 microseconds ($10^{-6}$ seconds) in accordance to the testing standards found in the UL 1449A standard. (For reference purposes, 8×20 is a standard waveform designation where the first numeral, here 8, represents the rise time of the transient in microseconds, and the second numeral, here 20, represents the duration time to 50% decay of the transient in microseconds.)

EXAMPLE 4

The method of Example 1 was repeated using spherical nickel particles with a nickel oxide coating made by the Novamet Company of Wyckoff, N.J. The coating quality and thickness, along with the oxygen content was verified in samples optically, electrically or spectroscopically. Comparable results were obtained.

Figure 3:
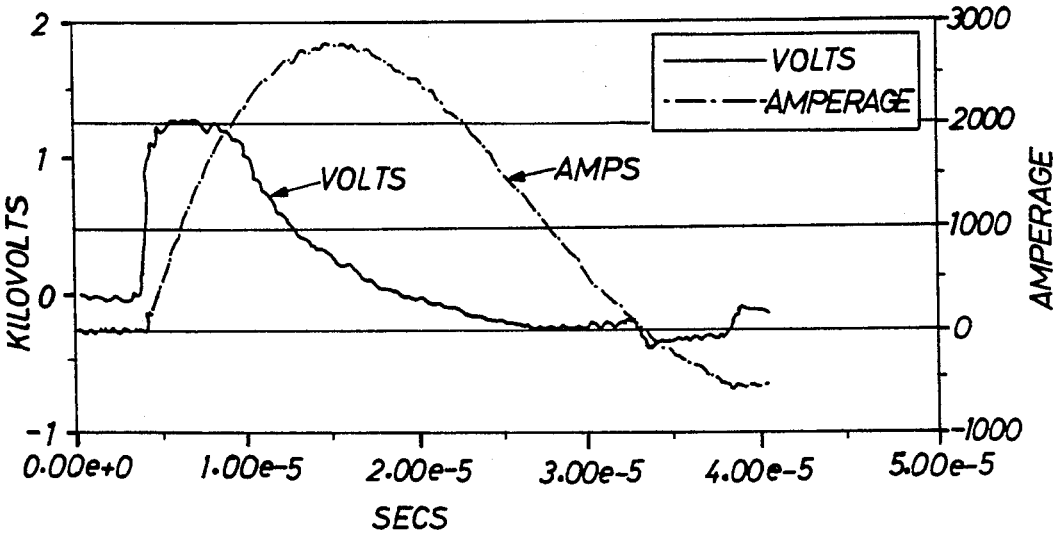
FIG. 3 is a graph showing the voltage and current response of the electrical overstress material of the invention when subjected to a voltage surge substantially above its clamping voltage.
Figure 4:
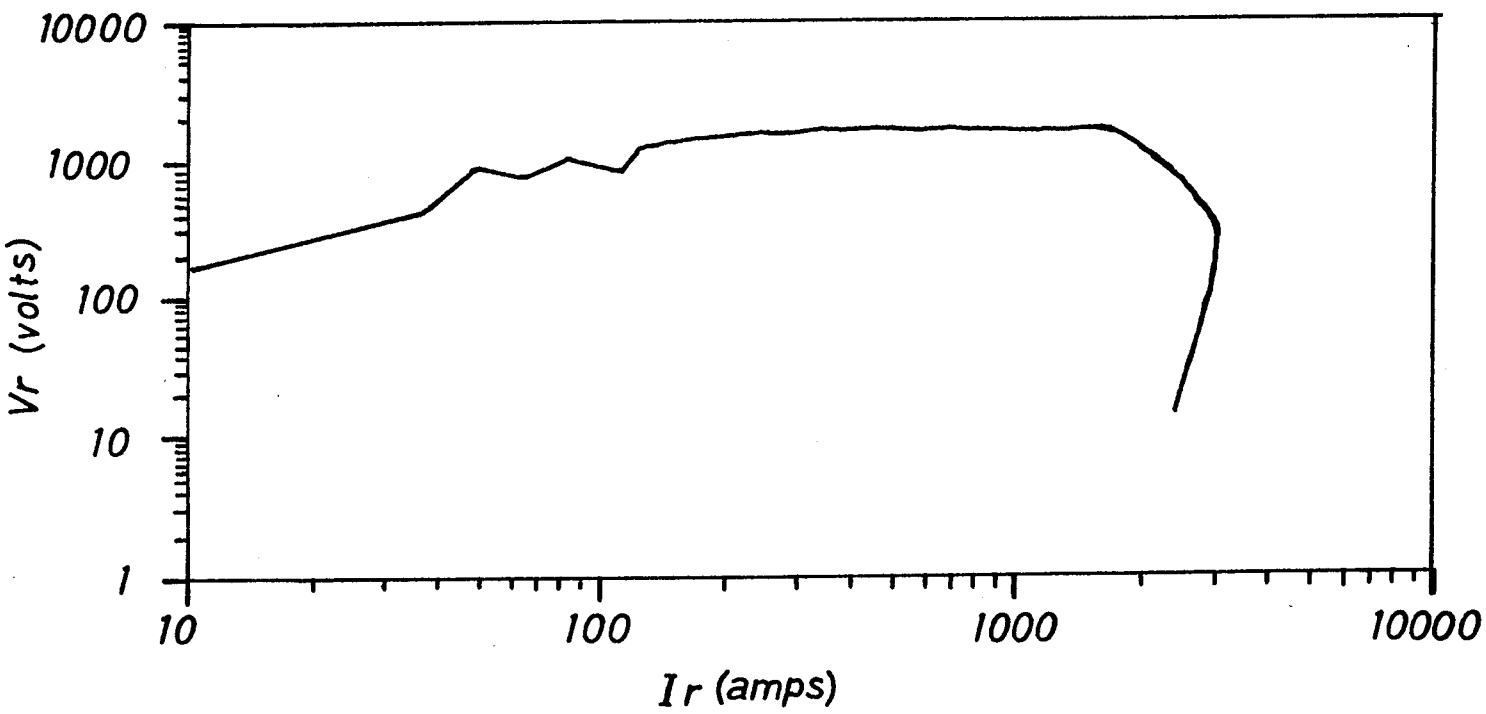
FIG. 4 is a graph constructed from the data of FIG. 2 showing the voltage and current responses respectively on the vertical and horizontal axes with such axes having a logarithmic scale; and, FIG. 5 is a graph constructed from test results obtained from subjecting a material embodying the present invention to multiple stressing pulses at 1.7 kV with a 400 picosecond risetime and 400 nanosecond duration.

The results of the electrical tests performed on the material produced by the method of Example 3 are shown in FIGS. 3 and 4 of the accompanying drawings.

Referring now to FIG. 3, this shows the voltage response V and current A produced by the application of a 6 kV, 3 kA surge across a sample of the material produced by the method of Example 3. The voltage may be read off the left-hand vertical scale, while the current is read off the right-hand vertical scale. Elapsed time is measured on the horizontal scale in tens of microseconds, $10^{-5}$ seconds.

The surge response shown can be described in five stages as marked on the drawing, numbers 1 to 5:

Stage 1. The voltage response rises very rapidly to a peak value of about 1500 volts. A surge current begins to flow immediately, (within the limits of measurement) rising steadily from zero.

Stage 2. The voltage response decreases rapidly owing to dielectric breakdown of the materials, and the current climbs to a peak value of about 2800 Amps.

Stage 3. The surge current decreases steadily and the voltage response drops more gradually to zero. The material is still absorbing surge energy at this stage.

Stage 4. The voltage response reverses polarity, the current drops to zero and the material dissipates energy.

Stage 5. The surge current changes polarity after the end of the transient and the material absorbs energy again.

FIG. 4 is a series of curves constructed from the data for FIG. 2 showing how the response voltage Vr, vertical scale, changes with the response current Ir, horizontal scale. Note, the scales are logarithmic.

The ratio of response of logarithmic current to response of logarithmic voltage (log $I_r$ vs log $V_r$) is called the alpha, i.e., nonlinear, characteristic of the material. As can be seen in FIG. 4, the alpha characteristic has a high, almost constant value in Stage 1 which increases owing to the dielectric breakdown of the material, and approaches infinity. In Stage 2, the "alpha" decreases and reaches zero. Stages 3, 4 and 5 show the response after the reverse of the applied surge current.

EXAMPLE 5

The method of Example 1 was repeated using approximately 28 volume percent of spherical nickel particles having a median particle size of 8.61 microns with a standard deviation of ±4.58 microns and repeated again using aluminum particles with a median particle size of 23.00 microns. Both product materials after curing and drying yielded a material which consistently removed test surges and maintained a fairly stable clamping voltage throughout a test surge.

While the above discussed the use of silicon rubber as the organic, polymeric support material of the invention, other binder materials are also within the scope of this invention.

Another advantageous binder material is a hard, thermoplastic acetal polymer which can yield high quality surge-arresting components that can be accurately molded with fine dimensions. However, unlike a thermosetting elastomer, acetal resins are thermoplastic and generally require high temperature processing conditions which may be as high as 400 degrees Centigrade. The processing techniques are modified accordingly using internal high-shear mixing rather than the roller mill described above.

The energy dissipation capacities of the materials of this invention relate not only to their composition but also their shape and disposition, and are of the order of 1 to 100 joules per cubic centimeter. The greater the cross-sectional area of the material, the higher the peak short circuit energy it can handle.

The material which is the product of the method of the present invention is useful as a surge arresting material that can be disposed in electrical contact across a pair of current carrying conductors to shunt out undesired surges that exceed the clamping voltage gradient of the material.

When this clamping voltage gradient is exceeded, the bulk resistivity of the surge arresting material drops and current flows through the material, diverting the surge. Electron transport, as by electron tunneling for example, occurs at the carefully controlled interfaces between the conductor particles and semiconductor particles, if present, generating heat adiabatically.

Electron transport by such means as quantum mechanical electron tunneling, proceeds so rapidly that the input electrical energy is only transferred to the electrons in the metal while it occurs. The input electrical energy passes through the conductive metallic particles because the electron-phonon interactions in their interfaces are minimal. After the transient, the metallic particles heat up due to the interaction of the electrons with its lattice. This heat is then dissipated through the semiconductor particles and the binder to the environment.

Depending upon the nature of the transient surge and its magnitude, the surge arresting material may recover completely and quickly from the surge or suffer varying degrees of degradation.

If the electron transport across particle interfaces is only quantum mechanical or electron tunneling, the material should recover, completely and quickly without any significant or detectable degradation. Thus, in many instances, it is preferred that quantum mechanical tunneling be the main means for electron transport in the material.

If other electron transport phenomena occur, such as electron avalanching or a thermionic condition, the material may suffer thermal runaway, with varying degrees of breakdown being possible. The material may still be functional with modest breakdown. Thus, while electron transport phenomena such as electron avalanching or a thermionic condition is also within the scope of the present invention, these methods may not be preferred in some applications into which the material is to be placed.

With less catastrophic surges, where quantum mechanical electron tunneling is the dominant electron transport phenomenon, the surge arresting material can be expected to function indefinitely, like a transistor switch.

One mode of electrical failure involves softening or melting of the conductive particles, leading to the formation of a permanently conductive filament through the surge-arresting material, as the conductor solidifies. Another possibility is that intense electron bombardment of a polymeric binder may reduce its dielectric strength and increase its conductivity. With some polymers, including silicone rubbers, high temperatures generated in the conductive particles may cause the polymer to expand and break conductive paths. This phenomenon can be advantageous if a high bulk resistivity response is required in the event that an excessive or unusually high energy surge is applied.

Other effects can occur with catastrophic surges. For example, the surge arresting material has, in some tests, ruptured, producing burn holes through the test samples. The edges of these holes show traces of molten pieces of metal with morphologies substantially different from the original conductor particle structure under high magnification scanning electron microscopy (SEM).

A further unexpected advantage of some of the preferred materials of this invention is that they are capable of displaying fail-safe characteristics. As the material heats in dissipating a high energy surge, the material also expands, moving the particles further apart, reducing electron transport effects and raising the clamping voltage. At higher temperatures it begins to break down, and, if gaseous products are generated, these may help to further expand the material. As an overwhelming or catastrophic surge develops, the peak let-through voltage is raised. What may eventually happen is that the material essentially takes itself off line and the transients go through rather than generate an unsafe condition or fire. In these cases, the material may be used in conjunction with a second upstream device to protect the circuit equipment if the material fails in the on state. In this manner the second upstream device will open and remove all surges from the circuit. Thus, there can be a smooth crossover from protection to safety.

A further feature of the invention comprises the inclusion of means in the material that encourage it to expand and become insulative at relatively higher temperatures, which may result in the generation of gases. The gases are preferably innocuous, for example carbon dioxide or water vapor, and can be produced by a variety of polymeric binders or by additives included for the purpose. Silicone rubber is an example of such an innocuous gas producing binder.

Since it is important to be able to monitor the condition of the surge arresting material of this invention while in use, so as to verify that it is capable of fulfilling its protective function, the material, or components incorporating it, may be provided with indicator means to display the material condition. One embodiment of such indicator means would be responsive to leakage of current through the surge arresting material at normal operating voltages, indicating the formation of one or more conductive chains therethrough which may attenuate the delivered voltage undesirably or may lead to progressive deterioration of the surge arresting material.

An indicator means of unusual, but not exclusive, value with a fail-safe or fail-open material is one that displays a distinctive visual characteristic, for example, a color change in response to a high temperature in the material, i.e., high enough to risk damage to the material, for example above 200 degrees Centigrade, or above 300 degrees Centigrade. Such an indicator means may be a thermochromic paint applied to the material in an exposed location or a thermochromic dye incorporated in the material, a portion of which is exposed or exposable in the end-product equipment. Such a dye preferably adds no significant electrical characteristics to the surge arresting material or only adds low-level controllable characteristics.

An alternative indicator device is a mechanically actuated flag or like indicator which could respond to expansion of the surge arresting material itself or to a bimetallic strip in thermal contact but not electrical contact therewith. A resettable mechanism could be devised using a nickel titanium alloy memory metal.

Another indicator means is a low temperature thermoplastic binder which, upon overheating as a result of one or more excessive or unusual surges, melts, taking itself out of the circuit and flowing to give a visual indication of failure.

Protected equipment or power supplies therefor which incorporate the surge arresting material of the present invention can also include test means with an audible or visual indicator of satisfactory performance of the surge arresting material which test means may operate by applying a test transient surge across the material, preferably when no power is being drawn by the protected equipment, and monitoring the induced voltage or current. For example, on a switched outlet, a warning light may be flashed, or a buzzer sounded or signal transmitted via RF means as a result of a successful test initiated by turning the pmwer switch off. A regular user would become accustomed to this signal and will be alerted to its absence.

Alternatively, continual low level, low energy, nondamaging test surges may be applied at regular, possibly frequent, intervals and warning or safety means can be actuated in the event of a test failure indicating the cessation of protection.

Some unique and advantageous properties have been found to be displayed by laminated materials formed in a plurality of sheet-like layers bonded together to provide a coherent film, sheet or slab of surge arresting material which, if based upon a suitably workable binder material, yield useful shaped products having novel and unexpected properties. Individual layers are generally quite thin and formed from a plastics or polymeric resin material, at least one layer of which has conductor particles, and optionally, semiconductor particles dispersed in it to provide a nonlinear material having a useful clamping voltage, while other layers are formed with different particulate dispersions, or with no particulate dispersion to have different electrical characteristics complementary to those of said one layer to provide a useful laminate material.

The primary layer is preferably a conductive particle layer, i.e., a substantially homogeneous dispersion of conductor particles in a self-supporting binder to provide a nonlinear resistance material having a useful clamping voltage. A relatively high proportion of conductive particles, such as a proportion near the percolation limit in the range of from 25 to 40% by volume of the material, is desirable and the material can advantageously be produced by the method described above, while a preferred binder is a moldable polymer, for example, a silicone rubber.

A conductive layer, film or strip of surge arresting material, i.e., conductive above a clamping voltage, or a layer capable of consistently forming a substantially conductive path above a clamping voltage is formed by using a material comprising a dispersion in the polymer of metallic or semiconductive particles, for example magnetic, black iron oxide, ferrosoferric oxide ($Fe_3O_4$). An electronic conductor type of semiconductor is preferred for this purpose.

This layered laminate material is intended to be used with a working voltage applied across the layers and while the just described conductive layer can be effective in providing surge diversion, a secondary current limiting layer is included in the material to assist in dispensing the energy of the transient in a passive manner.

This current limiting layer is a substantially homogeneous dispersion of conductor particles coated with an insulating or semiconductor material in a self-supporting binder. This layer need not necessarily provide a switching function (though it must have a relatively low, albeit significant, resistance above the clamping voltage of the primary conductor layer), it need not have both insulator-coated conductor and semiconductor particles. However, it is preferred that the current limiting layer include semiconductor particles which may or may not be coated.

A relatively high proportion of semiconductive particles, such as a proportion near the percolation limit in the range of from 25 to 40% by volume of the material, is desirable in the current limiting layer and such a material can advantageously be produced by the method described above, without including conductive particles, while a preferred binder is a moldable polymer, for example a silicone rubber. The semiconductor particles are packed in the binder with a spacing and size distribution to preferably encourage electron transport by quantum mechanical or electron tunneling, as described above, although electron transport by such other means as electron avalanche or thermionic transport are also contemplated to be within the scope of the invention.

A further preferred embodiment of the current limiting layer comprises a dispersion of both coated metallic conductor particles and uncoated semiconductor particles dispersed in a binder in accordance with the principles discussed and disclosed herein. The presence of semiconductor particles helps reduce the probability of the surge arresting material being burned by exceptional high energy transients.

An alternative current limiting layer is formed of a somewhat conductive polymeric material in a thin film having good heat dissipative properties, without the need to add semiconductor particles. While being conductive, the polymeric material used includes a moderate resistivity to attenuate the current surge.

A further embodiment of a laminated or layered surge arresting material comprises a three layer sandwich of the materials just described, namely two outer layers of the secondary current limiting material and an inner layer of the primary, conductor particle material.

For maximum protection, it is desirable to provide a surge arresting material capable of transmitting, diverting or surviving a surge current as high as 3000 amps, and such a laminate material can help achieve that end.

Where the end product use of this material may be as a flat or film-like surge arresting element that will have an operating voltage applied between its flat surfaces, the thickness of the material is such as to contain at least ten particles across the thickness, and preferably substantially more. Alternatively, the particle size may be selected according to the desired end product thickness to ensure that this result is achieved. In calculating the dimensions at the limit, regard is given to the thickness of any coating on the particles and to the spacing of the particles within the carrier. This consideration is relatively more important when using relatively large particles in thin film products. More preferred embodiments of the invention envisage product thicknesses of the order of 40 mils or 1000 microns and particle sizes in the range of 5 to 10 microns; which, with close packing in the carrier can provide at least 50 and close to 100 particles across the material thickness.

A key characteristic of some of the preferred "plain" and laminate surge arresting materials described herein is that they can be relatively easily worked, for example by rolling, pressing, molding or machining, into useful shapes. In particular, although these materials are by no means limited to such use, these materials may be used to provide protective components that can be incorporated into sensitive electrical and electronic equipment and assemblies, such for example as integrated circuit chips or printed circuit boards, or into power supply components for equipment such as computing, entertainment and telecommunications equipment, or indeed any other electrical or electronic equipment that might be damaged by extraneous surges, especially more or less random or unpredictable transients. The power supply components may comprise single-phase or two-phase power outlets, or multiple outlet power strips, or supply cables.

As a general principle it is desirable that the surge arresting material be shaped into a surge arresting component whose shape is adapted to conform with the equipment with which it is to be used. This surge arresting component is preferably disposed as a thin member with substantial conductor-contactable surfaces on opposed faces thereof such that these surfaces can contact a ground electrode or other ground contact surface on the one hand and a supply voltage electrode or contact on the other. Consistent with maintaining proper integrity and a substantially insulative resistance across the member below its clamping voltage, thinness, and preferably a uniform thinness, of the member is desirable to assist in providing a relatively low clamping voltage.

A desired clamping voltage will often be one that is sufficiently above the maximum normal peak voltage of the intended power supply, so as to ensure that normal applied voltages are not shunted out, (which could degrade the surge-arresting material and cause other undesired side effects) yet is sufficiently close thereto as to shunt most or substantially all transients that generate voltages significantly in excess of this normal peak voltage without having a catastrophic energy level. For example, utility power is generally supplied at approximately 120 volts a.c. having normal sine wave peaks of about 169 volts. A clamping voltage not higher than 500 volts and preferably in the range of 330 volts is desirable for optimal protection with this power supply.

The energy dissipation capacity of the surge arresting component relates to the contact areas so that the greater the area of the lesser of the two contact areas (which will define the plane or planes of the conductive volume through the component), the greater the energy dissipation capacity of the component and the greater the surge it can dissipate without damage to itself. Since the surge arresting component will also be shunting the normal applied voltage during an "event" (dissipation and diversion of a transient surge), drawing energy from the power system which will also have to be dissipated, it is desirable to minimize the dissipation time and the time taken to restore normal conditions, so as to minimize the energy drawn.

Thus, within the constraints of its host environment or equipment, the dimensions of the surge arresting component parallel to the contact surfaces is maximized for energy dissipation, while those, or preferably, the, dimension between them should be minimized for a desirably low clamping voltage.

In designing such a component it is preferred that the configuration of the surge arresting material and the electrodes be such as to tend to maintain the lines of an electric field applied between the electrodes equidistant from each other and of similar density, which is to say, as uniformly as other constraints permit. Following this principle will help minimize the risk of transient surges creating hot spots in the material which can weaken or destroy its unique electrical properties or mechanical integrity, or both. The presence of a hot spot in the electric field across the material is where the material will be stressed the most, and typically where it will fail. Accordingly, a desirable configuration for the surge arresting material is a coplanar arrangement where the material is sandwiched between two flat electrodes. An alternative design is a coaxial arrangement comprising a center conductor, an annular cylinder of surge arresting material around the center conductor, and an outer conductor around the cylinder of surge arresting material.

Figure 5:
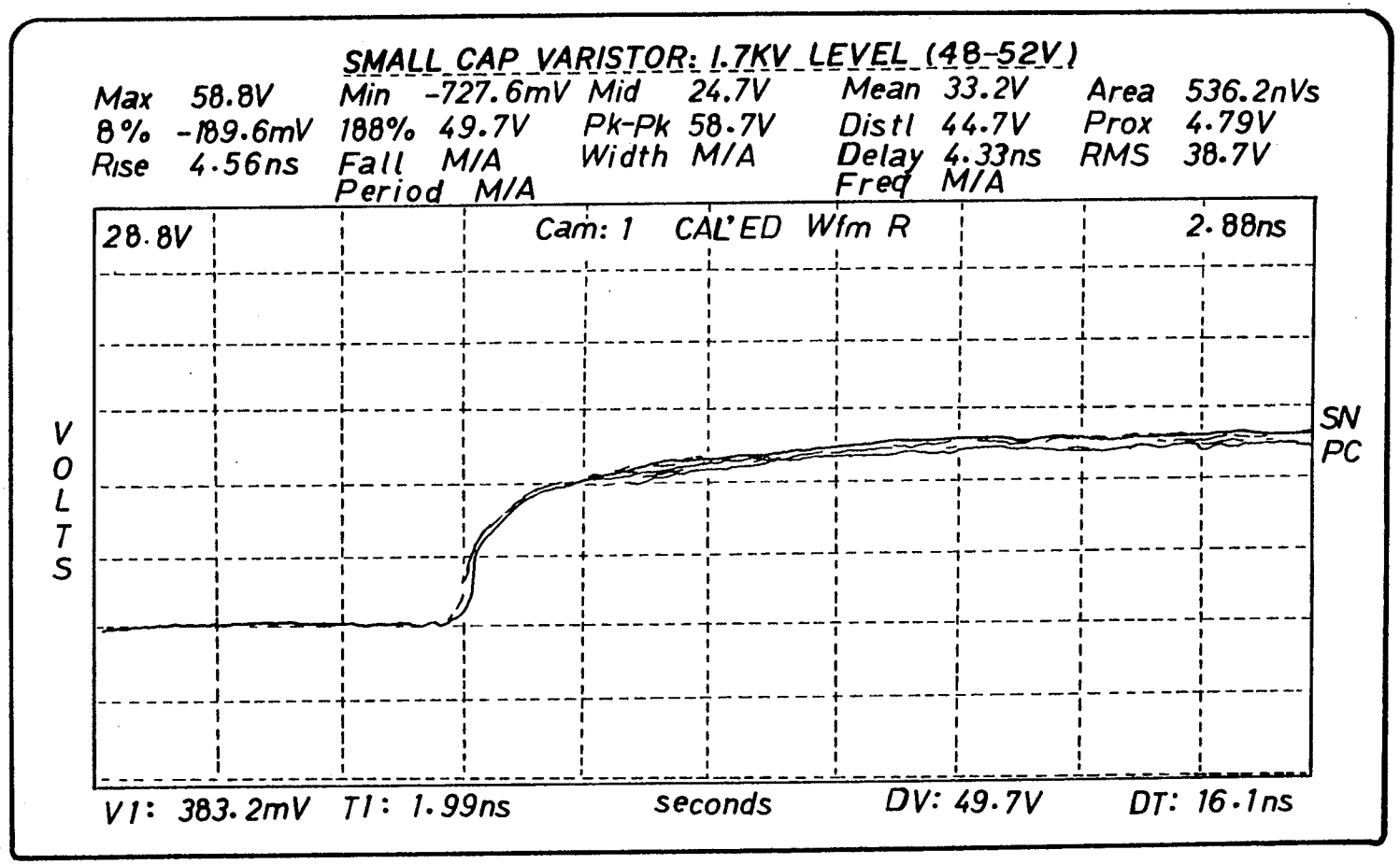

FIG. 5 illustrates the response of an application specific surge arresting material embodying the present invention, which was designed into a 50 Ohm coaxial N-type connector. The test material utilized a formulation that included coated aluminum spheres in a concentration above the percolation limit, mixed with a polymeric binder containing uncoated semiconductive particles acting as both a mechanical and electrical property enhancer. The test material survived multiple stressing pulses that were applied at 1.7 kV with a 400 picosecond risetime and 400 nanosecond duration, consistently clamping the threat waveform to approximately 40 Volts.

It is furthermore desirable to prevent arcing at the electrodes during a surge event by ensuring that all air paths between the electrodes are long enough that arcing is unlikely to occur. This may be achieved by having the surge arresting material overlap the electrodes.

It is also important to ensure that there are no voids or air spaces within the surge arresting material in the device or electrical or electronic components or equipment since voids or air spaces may cause undesired and potentially damaging arcing within the material during a surge event.

The present invention resides in the electrical overstress composite material, its composition, and its formulation. Since the surge arresting materials of this invention also bring unique advantages to the manufacture of products into which they are incorporated, the physical structure of its use in a particular environment is also within the scope of this invention, and such are known in the art and are readily adapted to, and designed for the specific environment of use. Obviously, as a bulk electrical resistance material, the prepared composite may be formed by compression molding in an elongate housing, and may be provided with conductive terminal end caps, as is conventional for such resistors. Alternatively, the prepared composite may be formed by conventional extrusion molding about a center conductor and encased within a conductive sheath or sleeve, so that an overstress pulse on the center conductor would be shunted through the composite to the outer sheath which, in use, would be grounded. Also, the composite may be incorporated into structural circuit elements, such as connectors, plugs and the like.

As stated above, since the surge arresting materials of this invention bring unique advantages to the manufacture of products into which they are incorporated, especially for example surge protected multiple outlet strips, one such application shall be described as indicative of the possible use of the material of the present invention. Thus, the subject surge arresting materials will allow automation of the assembly of an outlet strip, by way of example only, by making it into parts which snap in place and are held or captured in the device by a holder and are interconnected with the device through electrodes which mechanically mate to the holder and engage the material in an electronic circuit from one to another of the outlet electrodes which make contact with the connector plugs that are inserted through the front of the unit. Preferably the electronic circuit is made between line, neutral and ground, for each outlet.

A protected outlet strip can comprise a housing with integral walls which serve as spacers and locators for the outlet electrodes. Typically there are three electrodes for each outlet serviced by common conductor bars or strips: line, neutral and ground. These conductor bars are usually brass and are manufactured by stamping and forming and are then dropped into place within the outlet housing.

The conductor bars can be formed with contact points at one end for wiring to a power switch accommodated in the outlet housing, and to the line cord. The backs of the conductor bars are nominally planar and can be used as one of the contact surface areas for the surge arresting material. An electrode holder directly above the plug contact electrodes sandwiches the surge arresting material between that electrode and the electrode of the upper portion. This could be assembled by inserting the electrodes into the electrode holder, then the material strips can be dropped into place and this assembly can be loaded into the back housing, which is then closed with a back plate.

Standard outlet strips and surge protected outlet strips can be produced on a common assembly line by adapting the usual design of the standard strip to be like that of the surge protected strip and inserting a blank former in place of the surge arresting material. The former would have the same shape and size as the surge arresting material but would be made of an economical insulating material, for example cardboard or plastic. In this way, both products can be manufactured from a single mold or set of tooling. The three sectioned surge arresting material element completes a path for protection from neutral to ground and from line to ground. A further surge arresting material element completes the path from line to neutral. The surge arresting material lies on each conductor bar in three thin strips having thicknesses that are for example in a range of from 50 to 110 mil. This is a preferred system.

In a lower cost embodiment, both line and neutral are protected to ground and there is no line to neutral protection. However this system would raise the voltage protection level of a two-prong plug to nearly double that of a three-prong plug.

In summary, then, this invention can provide a power outlet strip offering new levels of protection from potentially damaging electrical transients, new levels of safety, unique mechanical strength and manufacturing advantages. Such protection is valuable for most expensive equipment and appliances for example, refrigerators and air conditioners. As technology advances, even these common household items can comprise microprocessors and other sensitive electronics that may be damaged by over voltage surges. Most electrical and electronic equipment can be expected to have a longer service life when given surge protection against overvoltage transients by devices and materials produced by this invention as indicated by studies carried out by the IEEE.

The embodiments of the invention disclosed and described in the present specification and drawings and claims are presented merely as examples of the invention. Other embodiments, forms and modifications thereof will suggest themselves from a reading thereof and are contemplated as coming within the scope of the present invention.

What is claimed is:

1. A method of preparing a nonlinear electrical resistance material useful for protecting electrical equipment against transient surges which method comprises the steps of:

composing a mixture comprising a curable adhesive fluid binder of substantially insulative electrical resistivity, and electrical filler material comprising conductor particles having an applied coating of not less than 70 Angstroms nor more than 1 Micron, and semiconductor particles having no applied coating, wherein the electrical filler material is present in an amount from 15 to 97 volume percent of said mixture;

mixing said mixture until a uniform consistency is obtained of said particles in said binder and the particles are substantially all coated with said binder;

molding said mixture under pressure into a shaped, coherent self-supporting material to pack the particles closely together with interparticle spaces filled with binder and substantially free of voids to provide a material having a clamping voltage such that it presents substantially an open circuit to voltage surges below said clamping voltage, said material being capable of maintaining said clamping voltage after repeated surges in excess of said clamping voltage, and said material being capable of repeatedly conducting said surges in excess of said clamping voltage by electron transport.

2. The method of claim 1, further comprising selecting median particle sizes for both conductor and semiconductive particles of from 100 angstroms to 100 microns.

3. The method of claim 1, further comprising coating at least some of said conductor particles with insulative material before composing said mixture.

4. The method of claim 1, further comprising coating at least some of said conductor particles with semiconductive material before composing said mixture.

5. The method of claim 1 further comprising using at least 50 volume percent of conductor particles and at most 50 volume percent of semiconductor particles in said electrical filler material.

6. A nonlinear electrical resistance material comprising:

a binder of substantially insulative electrical resistivity;

electrical filler material comprising conductor particles having an applied coating of not less than 70 Angstroms nor more than 1 Micron and semiconductor particles having no applied coating, said conductor particles and said semiconductor particles being distributed throughout said binder such that said material is substantially homogeneous and free of voids, and wherein the electrical filler material is present in an amount from 15 to 97 volume percent of said nonlinear electrical resistance material;

said nonlinear electrical resistance material having a clamping voltage such that it presents substantially an open circuit to voltages below said clamping voltage, and said nonlinear resistance material being capable of repeatedly conducting voltage surges in excess of said clamping voltage by electron transport.

7. The nonlinear electrical resistance material of claim 6 wherein at least some of said conductor particles each comprise an interior of insulative material surrounded by a layer of conductive material.

8. The nonlinear electrical resistance material of claim 6 wherein at least some of said conductor particles each comprise an interior of semiconductive material surrounded by a layer of conductive material.

9. The nonlinear electrical resistance material of claim 6 wherein said binder comprises an elastomeric polymer.

10. The nonlinear electrical resistance material of claim 9 wherein said elastomeric polymer is silicone rubber.

11. The nonlinear electrical resistance material of claim 10 wherein said silicone rubber consists of a polysiloxane of general formula $R_2SiO$— where R is a monovalent organic radical.

12. The nonlinear electrical resistance material of claim 9 wherein said binder further comprises an inert filler.

13. The nonlinear electrical resistance material of claim 12 wherein said inert filler is calcium carbonate.

14. The nonlinear electrical resistance material of claim 12 wherein said inert filler is a silicon compound.

15. The nonlinear electrical resistance material of claim 6 further comprising an insulative coating for at least some of said conductor particles.

16. The nonlinear electrical resistance material of claim 6 further comprising a semiconductive coating for at least some of said conductor particles.

17. The nonlinear electrical resistance material of claim 6 wherein said binder is a paste-like ceramic material.

18. The nonlinear electrical resistance material of claim 6 wherein said conductor particles are made of nickel and said semiconductor particles are made of silicon carbide.

19. The nonlinear electrical resistance material of claim 6 wherein said electrical filler material comprises at least 50 volume percent conductor particles and at most 50 volume percent semiconductor particles.

20. A nonlinear electrical resistance material comprising:

a binder of substantially insulative electrical resistivity;

electrical filler material comprising conductor particles having no coating and semiconductor particles having an insulative coating, said conductor particles and said semiconductor particles being distributed throughout said binder such that said material is substantially homogeneous and free of voids, and wherein the electrical filler material is present in an amount from 15 to 97 volume percent of said nonlinear electrical resistance material;

said nonlinear electrical resistance material having a clamping voltage such that it presents substantially an open circuit to voltages below said clamping voltage, and said nonlinear resistance material being capable of repeatedly conducting voltage surges in excess of said clamping voltage by electron transport.

* * * * *